US008919580B2

(12) United States Patent
Johnson et al.

(10) Patent No.: US 8,919,580 B2
(45) Date of Patent: Dec. 30, 2014

(54) ERGONOMIC MERCHANDISING SYSTEM

(75) Inventors: Terry J. Johnson, Chicago, IL (US); Travis Ogden Johnson, Chicago, IL (US)

(73) Assignee: Gamon Plus, Inc., Elk Grove Village, IL (US)

( * ) Notice: Subject to any disclaimer, the term of this patent is extended or adjusted under 35 U.S.C. 154(b) by 0 days.

(21) Appl. No.: 13/604,547

(22) Filed: Sep. 5, 2012

(65) Prior Publication Data

US 2013/0068708 A1 Mar. 21, 2013

Related U.S. Application Data

(63) Continuation of application No. PCT/US2011/027261, filed on Mar. 4, 2011.

(60) Provisional application No. 61/310,814, filed on Mar. 5, 2010.

(51) Int. Cl.

| | |
|---|---|
| ***A47F 1/04*** | (2006.01) |
| ***G07F 11/30*** | (2006.01) |
| ***A47F 1/12*** | (2006.01) |
| ***A47F 5/00*** | (2006.01) |
| *B07C 1/02* | (2006.01) |

(52) U.S. Cl.

CPC . *A47F 1/04* (2013.01); *B07C 1/025* (2013.01); *G07F 11/30* (2013.01); *A47F 1/12* (2013.01); *A47F 5/0043* (2013.01)

USPC ..... 211/59.2; 211/59.4

(58) Field of Classification Search

CPC ..... B07C 1/025; B07C 3/008; G07F 11/28; G07F 11/30; G07F 11/18; G07F 11/38; A47F 5/0068; A47F 5/005; A47F 5/0062; A47F 1/04; A47F 1/12; A47F 1/0043

USPC ..... 211/59.2, 59.3, 59.4, 186, 187, 151, 211/90.1, 90.02; 221/2, 3, 151, 251, 255, 221/257, 275, 281, 301; 209/706, 900

See application file for complete search history.

(56) References Cited

U.S. PATENT DOCUMENTS 2,784,872 A * 3/1957 Lux ..... 221/207
3,894,634 A * 7/1975 Gotham et al. ..... 211/150

(Continued)

FOREIGN PATENT DOCUMENTS

| | | |
|---|---|---|
| EP | 0 787 447 A1 | 6/1997 |
| EP | 1 597 986 A1 | 11/2005 |
| JP | 2005270416 | 10/2005 |

OTHER PUBLICATIONS

English language abstract of JP2005-270416(A), publication date Oct. 6, 2005, applicant Sanden Corp.

*Primary Examiner* — Korie H Chan

(74) *Attorney, Agent, or Firm* — Tiajoloff and Kelly LLP

(57) ABSTRACT

A display apparatus for articles having substantially the same size comprises an inclined structure supporting the articles for sliding forward and rearward movement thereon. A first stop structure prevents forward movement of the articles beyond a first stop point. A second stop structure moves between first and second positions in which it, respectively, stops articles at a second stop point rearward of the first stop point, and permits articles to move forward past the second stop point. The second stop structure is biased so as to move toward the first position, and it moves to the second position when an article is at the first stop point, which allows a rearward article to slide forward past the second stop point.

27 Claims, 33 Drawing Sheets

(56) References Cited

U.S. PATENT DOCUMENTS

| | | | | | |
|---|---|---|---|---|---|
| 4,064,996 | A | * | 12/1977 | Shillum | 211/191 |
| 4,314,648 | A | | 2/1982 | Spamer | |
| 5,115,920 | A | * | 5/1992 | Tipton et al. | 211/59.2 |
| 5,779,064 | A | | 7/1998 | Dolling | |
| 5,944,201 | A | * | 8/1999 | Babboni et al. | 211/151 |
| 5,992,651 | A | * | 11/1999 | Shaw et al. | 211/59.2 |
| 6,435,353 | B2 | * | 8/2002 | Ryan et al. | 209/706 |
| 6,533,131 | B2 | | 3/2003 | Bada | |
| 7,757,890 | B2 | * | 7/2010 | Alford et al. | 221/2 |
| 2001/0002659 | A1 | | 6/2001 | Bada | |
| 2007/0080166 | A1 | * | 4/2007 | Alford et al. | 221/257 |
| 2007/0289990 | A1 | * | 12/2007 | Artsiely | 221/251 |

* cited by examiner

ERGONOMIC MERCHANDISING SYSTEM

RELATED APPLICATIONS

This application is a continuation of international application PCT/US2011/027261 filed on Mar. 4, 2011, which designated the United States of America, was published on Sep. 9, 2011 as publication WO 2011/109749 A2, which is herein incorporated in its entirety by reference, and claimed the benefit of U.S. provisional application Ser. No. 61/310,314 filed Mar. 5, 2010, which is herein incorporated in its entirety by reference.

FIELD OF THE INVENTION

The present invention relates to product displays and dispensers and, more particularly, to gravity feed dispensers capable of dispensing relatively heavy products or packaged products such as, for example, cartons of soft drink cans.

BACKGROUND OF THE INVENTION

Cartons of canned beverages are typically stocked in grocery stores on horizontal shelves in lay flat fashion, sometimes in stacks. As consumers remove cartons, remaining cartons must be moved forward by hand, either by stock workers or the consumer attempting to purchase the product. The standard method of stocking relatively heavy cartons is ergonomically unsatisfactory for the consumer (as well as for the stocker), who must bend, pull and lift the carton before placing it into his or her cart. The stock worker must shove the cartons from the aisle side of the store shelf toward the rear until the shelf is fully stocked. Also, the soft drink aisle of grocery stores has long been considered unexciting from a merchandising point of view.

For lighter items, such as pharmaceuticals, various pusher mechanisms have long been employed to urge products forward horizontally. U.S. Pat. No. 7,628,282 discloses a display system incorporating rollers and a pusher for moving heavier products such as cartons of soft drinks. Rather than reliance on pusher mechanisms, some displays incorporate shelving that is sloped to enable a gravity feed such as, for example, is shown in U.S. Pat. No. 4,809,855. However, such pusher systems and gravity feed systems do not address or resolve the ergonomic problems noted above, nor do they improve the visual appeal of the stocked items. These systems also do not afford the consumer an easy way to return product should the consumer wish to do so after removing the product from the display.

Thus, a need exists for an improved system for stocking and presenting relatively heavy products such as cartons of soft drinks to the consumer while at the same time enhancing the visual appearance of the stocked product and the involved store aisle. A need also exists for a system that permits easy return of product after removal.

SUMMARY OF THE INVENTION

A product display apparatus in accordance with the invention comprises a frame, a product slide mechanism mounted on the frame including spaced front and rear end portions with the front end portion being vertically lower than the rear end portion to define a descending product travel path therebetween. A first product stop mechanism is disposed proximal the front end portion, and a lock mechanism serving as a second product stop mechanism disposed along the slide mechanism in predetermined offset relation to the first stop mechanism. The second stop mechanism has product blocking and non-blocking orientations. The second stop mechanism is biased to its blocking orientation, and responsive to force applied generally downwardly thereon, assumes its non-blocking orientation.

In a preferred embodiment, the slope of the travel path is increased near the front end portion of the slide mechanism such that the most forward of the products is tilted outwardly relative to the remaining products to facilitate removal by the consumer. In a typical application wherein the displayed products are of common configuration and have a side disposed on the slide mechanism, the width of the side that extends longitudinally of the slide mechanism is less than the aforementioned predetermined offset so that a downward force is maintained on the second stop mechanism when the tilted product is removed by the consumer. This allows the remaining product to move to the first stop. Conversely, when loading the display the store worker places a product onto the second stop mechanism and pushes the product rearwardly until it passes the second stop mechanism thereby allowing the second stop mechanism to assume its product blocking orientation. Another product can then be placed onto the second stop mechanism without interference and can be pushed along with the previously loaded product rearwardly until such another product passes the second stop mechanism. This procedure can be repeated until the dispenser is fully loaded.

The slide mechanism in a preferred embodiment includes at least one roller assembly that includes a plurality of rollers each having a rotation axis extending transversely of the travel path. In this embodiment, the slope of the slide mechanism from the rear end portion to the location of the second stop mechanism can be minimized to about 5 degrees relative to horizontal with the slope of the tilted portion of the slide mechanism being about 45 degrees.

According to an aspect of the invention, a display apparatus for a plurality of articles all having substantially the same size comprises an inclined support structure sloping forwardly and downwardly and supporting the articles for sliding forward and rearward movement thereon. A first stop structure is configured to prevent forward movement of the articles beyond a first stop point, and a second stop structure is supported for movement between first and second positions. When the second stop structure is in the first position, the second stop structure is configured so as to prevent forward movement of the articles through a second stop point located at a distance rearward of the first stop point. When the second stop structure is in the second position, the second stop structure permits an article rear of the second stop point to move forward past the second stop point. The second stop structure is biased so as to move toward the first position, and is configured so that the second stop structure moves to the second position thereof when one of the articles is retained by the first stop structure at the first stop point, allowing another of the articles to slide past the second stop point.

Preferably the articles are all rectangular cartons of substantially the same dimensions.

In the preferred embodiment, the inclined support structure comprises a pair of laterally spaced inclined sliding support structures each supporting a respective end of the articles. The display apparatus includes structure that permits rearward and forward movement of the articles but prevents twisting movement of the articles, including two laterally spaced walls laterally outward of the inclined sliding support structures.

The support structures preferably each include a respective sloping set of roller structures on which the articles can move forward and rearward. The roller structures each having a plurality of rollers supported in a coplanar relation for rotative movement, and preferably the rollers each have a cylindrical shape with recesses therein that permit draining of liquid therethrough.

In one embodiment, the first stop structure includes a wall positioned so that a forwardmost one of the articles slides down and engages the wall. The wall is angulated relative to the inclined support structure such that the forwardmost one of the articles is rotated to a greater downward angle than an angle of incline of the support structure, and at an angle relative to any other of the articles supported in the display apparatus. This angle is preferably 45 degrees and permits easy removal of the article by a customer, and also enhances the appearance of the display. In one embodiment of the invention, the wall has an upper portion that extends upwardly above the forwardmost one of the articles such that another of the articles placed on top of the forwardmost one of the articles rests on the upper portion of the wall.

According to an aspect of the invention, the second stop structure comprises a latch member that is pivotably supported on the sliding support structure. The second stop structure may be biased to the first position by a spring structure or a counterweight structure.

The latch member has a rearward disposed abutment portion that engages a forward portion of one of the articles at the second stop point and prevents that article from moving forward. When the latch member is pivoted toward the second position, the abutment portion of the latch member is below an upper surface level of the sliding support structure such that the article can slide forward above the abutment portion. Also, the latch member may have an upper surface engagement portion, and, when a forwardmost one of the articles is stopped at the first stop point, the forwardmost article rests upon the upper surface engagement portion and moves the latch member toward the second position such that the abutment portion is below the said upper surface level. The next rearward one of the articles behind the forwardmost article then can slide forward, and it then will rest against a rear portion of the forwardmost article.

When the forwardmost article is manually pushed rearward past the second stop point, the latch member moves so that the abutment portion is above the upper surface level, and when the forwardmost article is released, the article slides forward to rest against the abutment portion at the second stop point, leaving a space open forward thereof into which an additional article may be loaded onto the display apparatus.

According to an aspect of the invention, the display apparatus is supported on a vertical post having a series of vertical slots therein, and has a rearward portion having a plurality of hook structures extending into the slots and releasably securing the display apparatus thereto. One of the hook structures has an upward protruding portion extending into a slot of the vertical member configured so that to remove the display apparatus from the vertical member, the display apparatus must be first lifted upward, and then tilted with a forward portion thereof elevated before the display apparatus can be withdrawn forwardly from the vertical post.

According to another aspect of the invention, the display apparatus includes an understructure on which the support structure is fixedly secured. The understructure includes a plurality of lateral members each having an upper wall comprising a pair of flanges defining a laterally extending slot therebetween in the upper wall. The support structure has a bolt supported therein screwed into an attachment member, the attachment member being narrower in a first horizontal direction than the slot, and being wider than the slot in another perpendicular horizontal direction. As a result, the attachment member is inserted into the slot and the bolt is then turned so as to cause the attachment member to be entrapped below the flanges of the upper wall and to secure the support structure to the lateral member. Preferably the attachment member is tapered in the first horizontal direction at an upper end and a lower end thereof such that the attachment member can be readily inserted into and removed from the slot during assembly or disassembly of the display apparatus.

Another aspect of the invention is a method of making a rack with rollers used in the display device of the invention. This method comprises providing a deck member having a number of recesses therein each configured to receive a roller of a predetermined configuration, and providing a tree having that number of roller elements each according to the predetermined configuration. The tree is placed over the deck member so that each of the roller elements aligns with a respective recess, and the roller elements are pressed into the recesses so that the roller elements separate from the tree and rotate individually in the respective recesses.

Preferably, the deck member has guide openings positioned therein, and the tree has alignment posts that, when fit into those openings, align the roller elements of the tree with the recesses in the deck member. The roller elements each have an axle portion extending outwardly from a cylindrical body thereof, and the deck member includes protrusions extending over the recesses. The protrusions flex slightly, permitting entry of the roller element axle portions into the recess and then entrapping the roller element axle portions therein.

Especially preferred is that the roller elements are pressed substantially simultaneously into said recesses and broken away from said tree, especially using an arbor press.

Also according to an embodiment, the cylindrical bodies of the roller elements have annular recesses extending circumferentially therearound. In the preferred embodiment, the tree is cast plastic or another material, and it is formed integral with the roller elements such that links between the roller elements and the remaining portion of the tree are broken when the roller elements are pressed into the recesses.

DETAILED DESCRIPTION

General Overview

Figure 1:
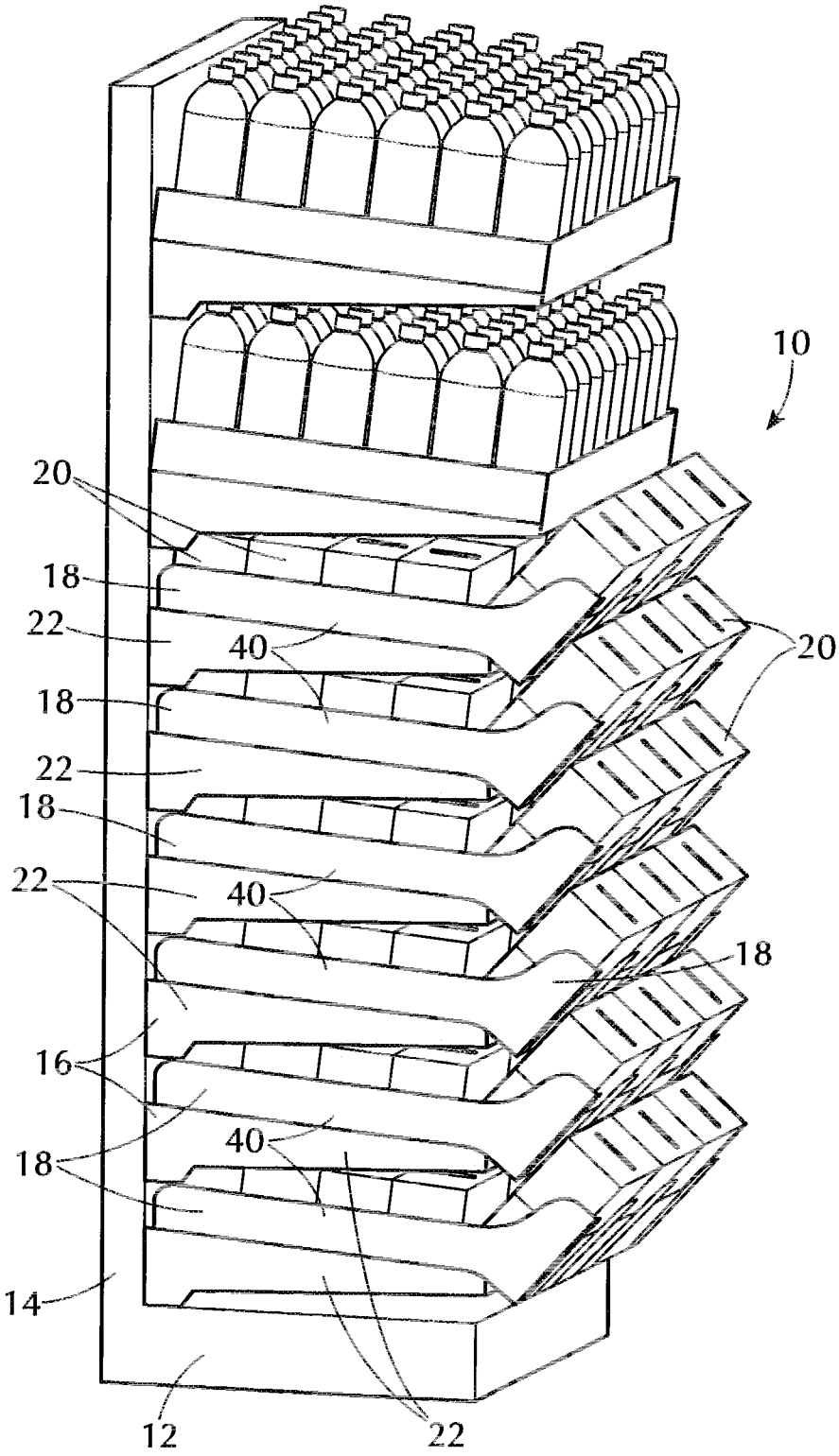
FIG. 1 is an isometric view of illustrating one application of the display system of the present invention loaded with cartons of soft drinks.
Figure 2:
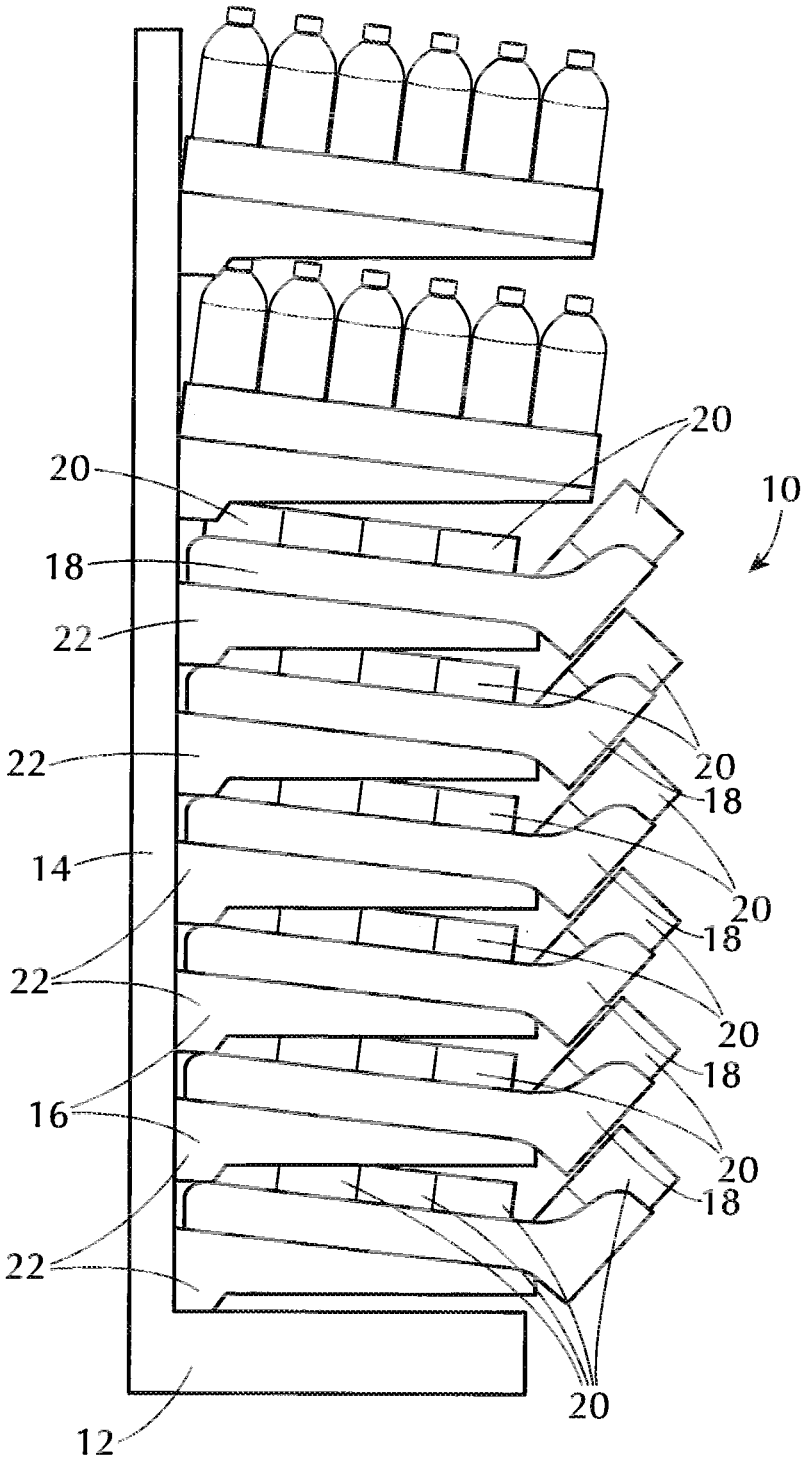
FIG. 2 is a side elevation view of the display of FIG. 1.
Figure 3:
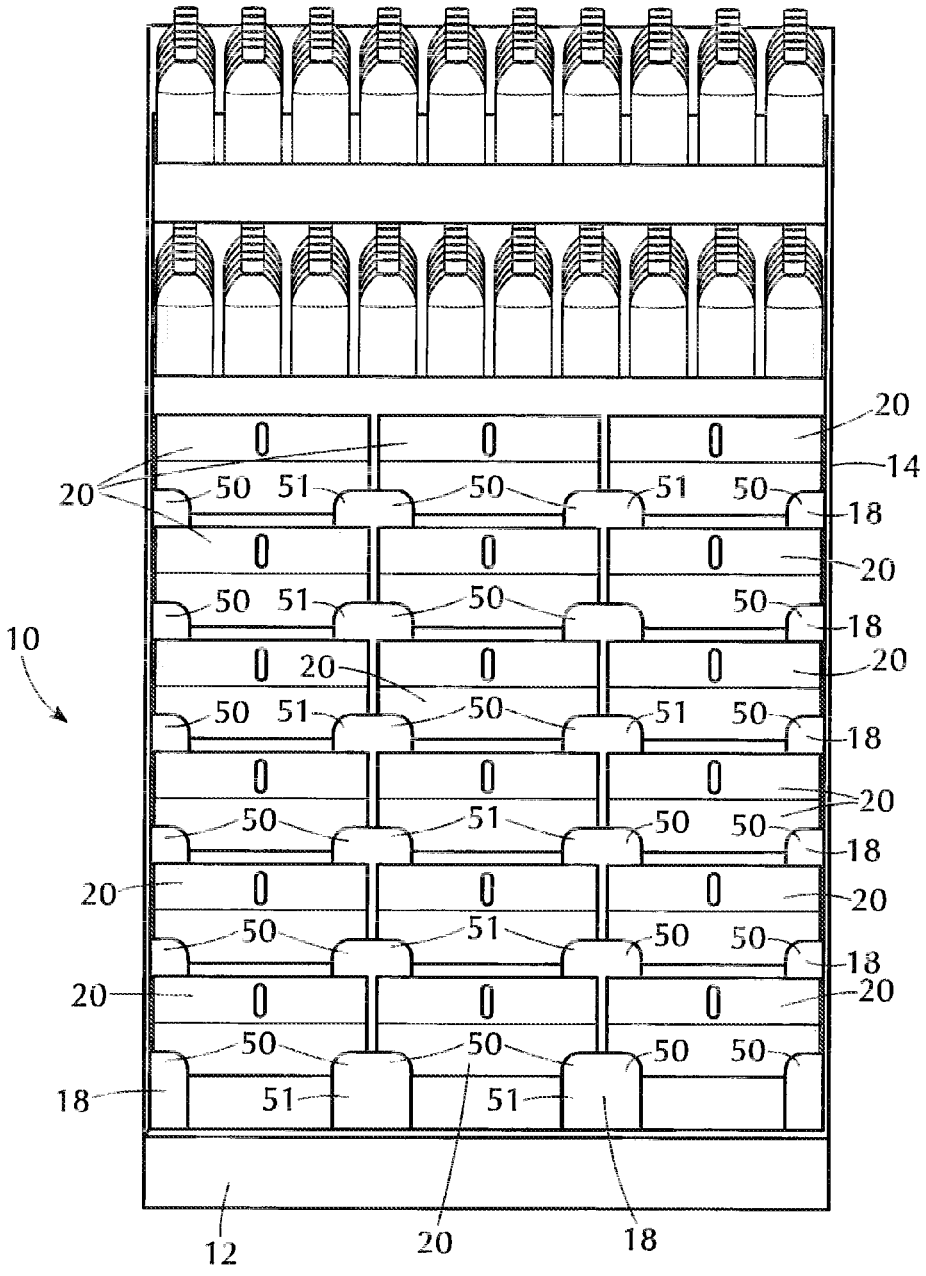
FIG. 3 is a front elevation view of the display of FIG. 2.

As best seen in FIGS. 1 to 3, a display system 10 incorporating the invention is affixed to a standard gondola that includes a base 12 and an upright assembly 14. As is well known, assembly 14 conventionally includes spaced vertical bars (not shown in FIGS. 1 to 3) that have vertical rows of vertical slots that receive cooperating hooks of shelving at a variety of user-selectable heights. The display system includes a series of vertically spaced frame assemblies 16 supporting product slide assemblies 18. The display system is shown loaded with 12-pack cartons 20 of soft drinks, which are all roughly of the same rectangular shape and dimensions. The display system 10 is shown in a fully loaded condition; that is, two cartons with one atop the other are at the product removal position. Once the upper of the two product is removed by a consumer, the space vacated serves as a product return space.

Details of an exemplary frame assembly for supporting racks with cartons 20 are shown in FIGS. 4 to 11.

Figure 4:
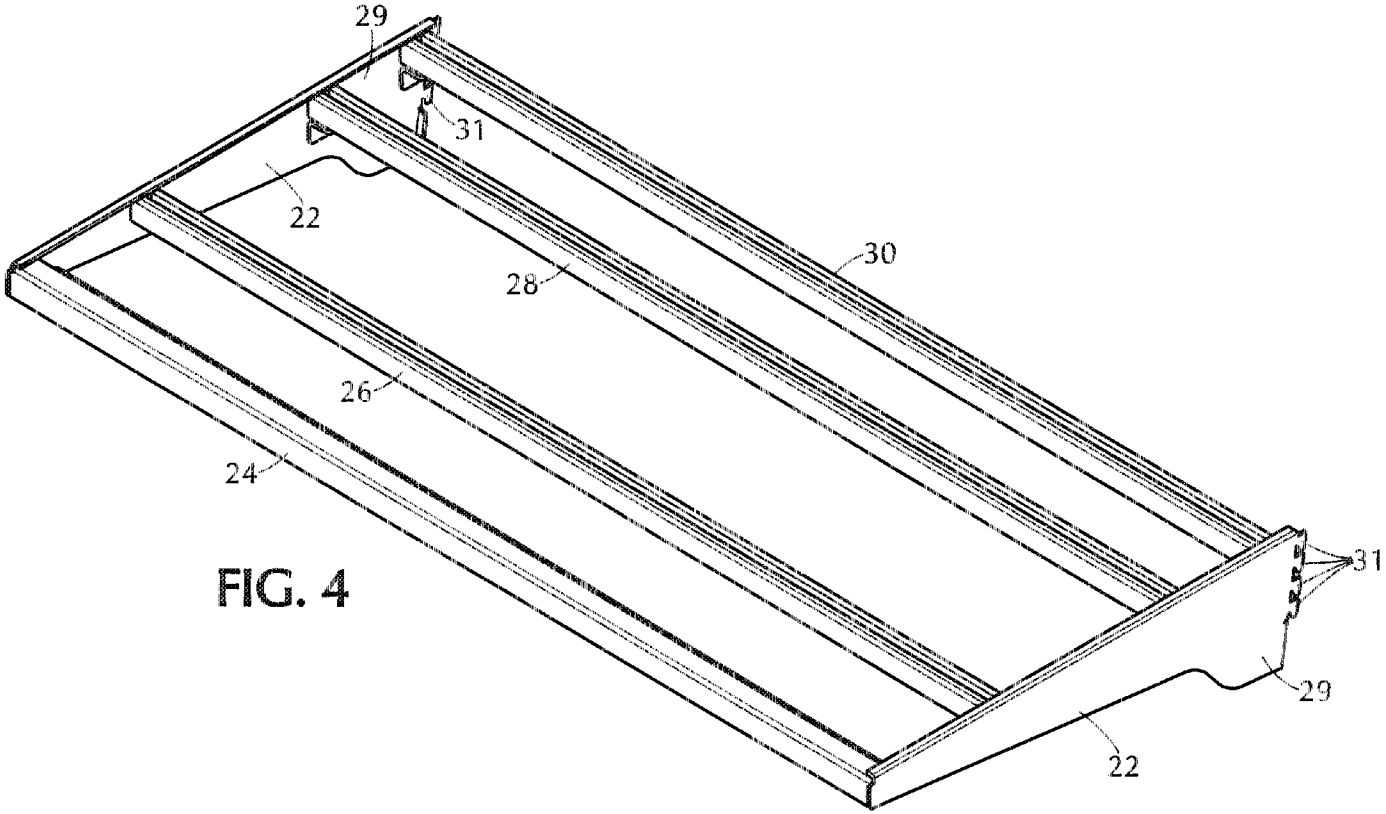
FIG. 4 is an isometric view of a frame assembly used in the display of FIG. 1.
Figure 5:
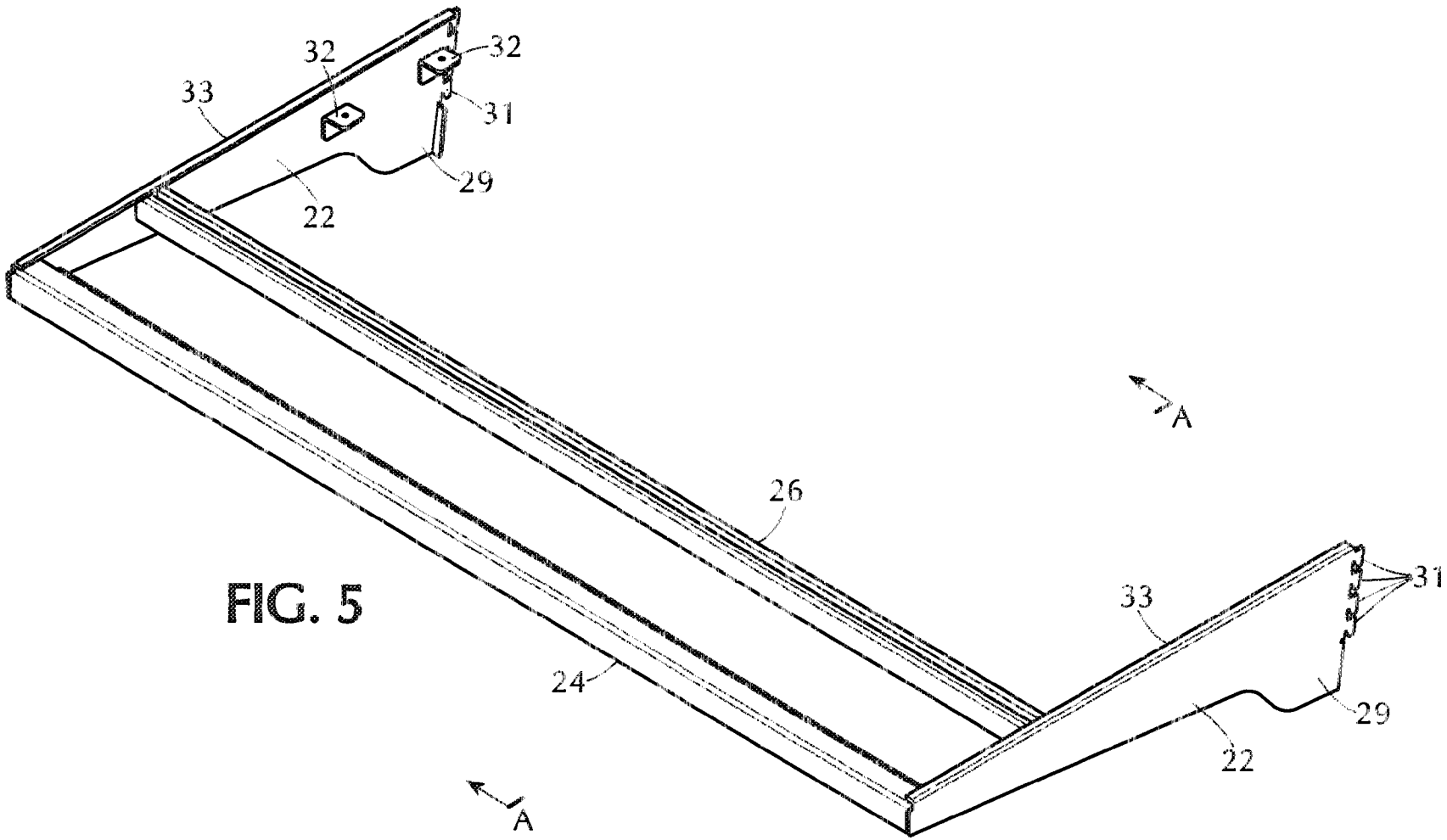
FIG. 5 is an isometric view of a frame similar to FIG. 4, but with cross braces removed to show additional details.
Figure 6:
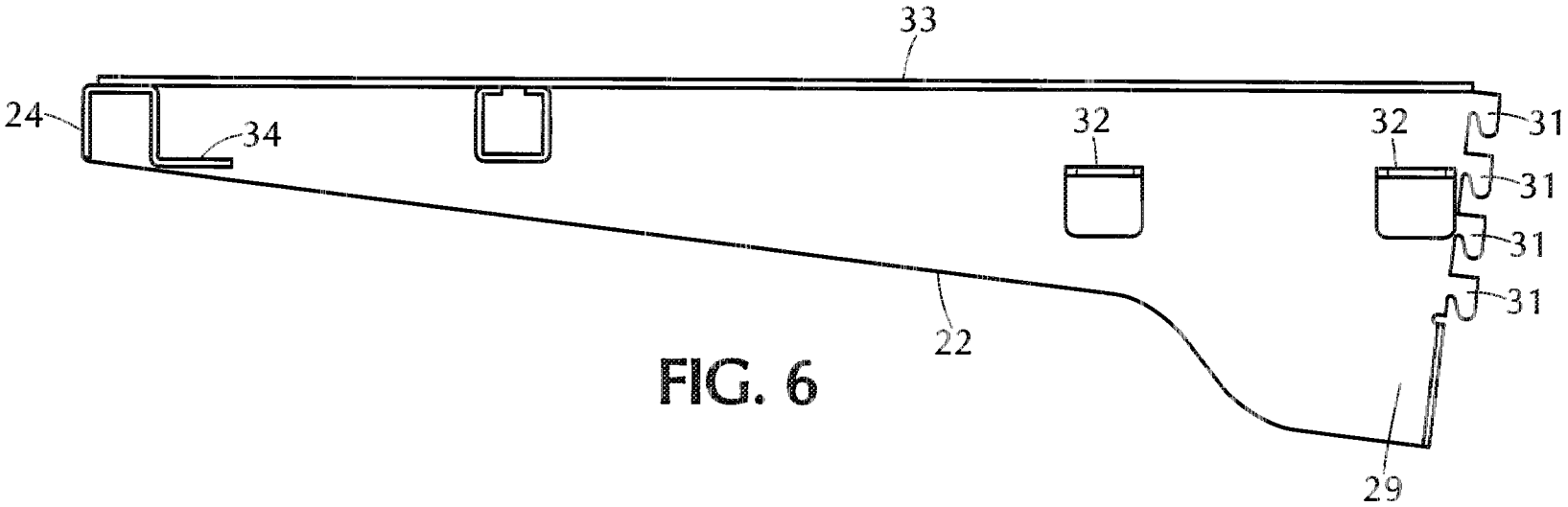
FIG. 6 is a cross-sectional view of the frame assembly of FIG. 4 taken from line A-A.

Referring to FIG. 4, the frame assembly 16 includes laterally spaced support arms 22, and transverse cross braces 24, 26, 28 and 30. The arms and braces of the exemplary embodiment are formed of metal such as 11 gauge, 70 yield HSLA. Referring to FIGS. 5 and 6, cross braces 24 and 26 are spot welded or otherwise fixedly secured to the arms 22. Cross braces 28 and 30 are secured by bolts or the like to angle flanges 32 that are welded to arms 22. The rear portion 29 of each of the arms 22 is provided with one or more hook-shaped protrusions 31 that hook into the slots in the vertical posts of the display system 10 so as to support the aim 22 extending forward therefrom, as is well known in the art. Each of the pair of arms 22 is a mirror image of the other of the pair.

Figure 7:
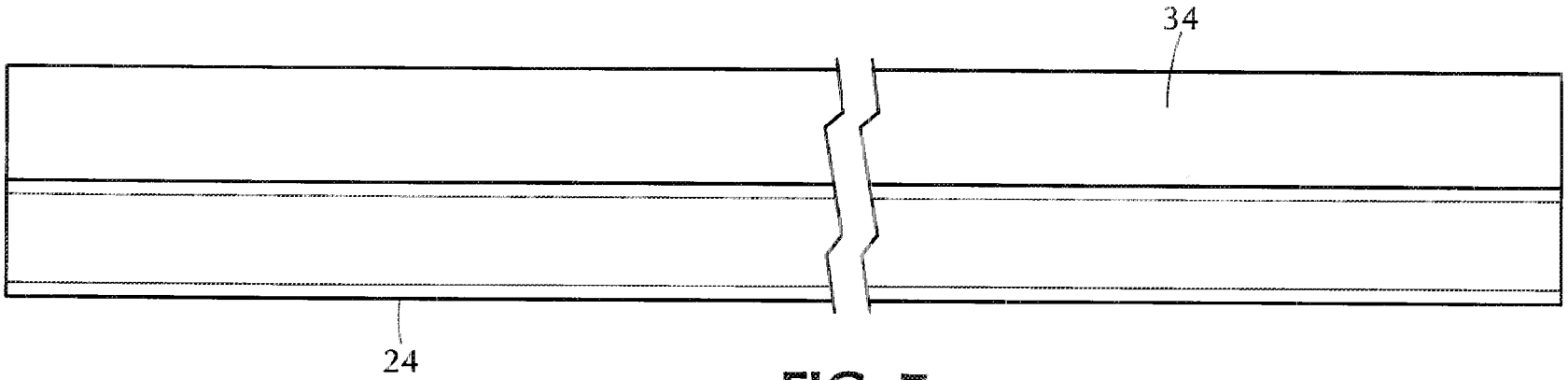
FIG. 7 is a bottom view of the front cross brace of the frame assembly of FIG. 4.
Figure 8:
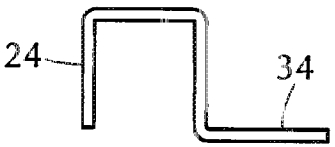
FIG. 8 is a side view of the cross brace of FIG. 7.
Figure 9:
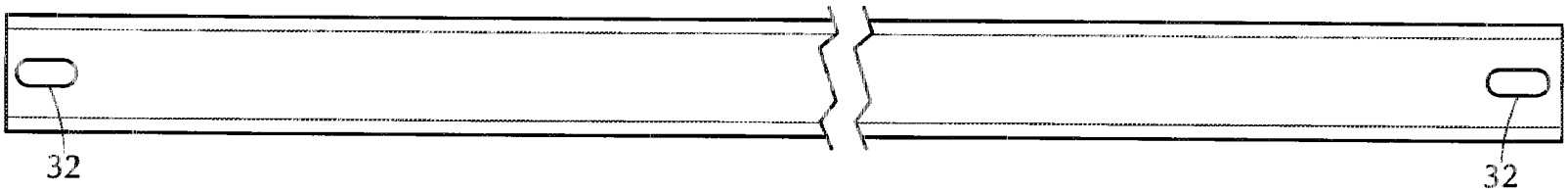
FIG. 9 is a bottom view of the cross braces other than the front cross brace of the frame of FIG. 4.
Figure 10:
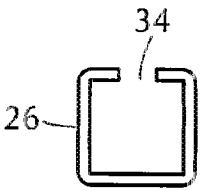
FIG. 10 is a side view of the cross brace of FIG. 9.
Figure 11:
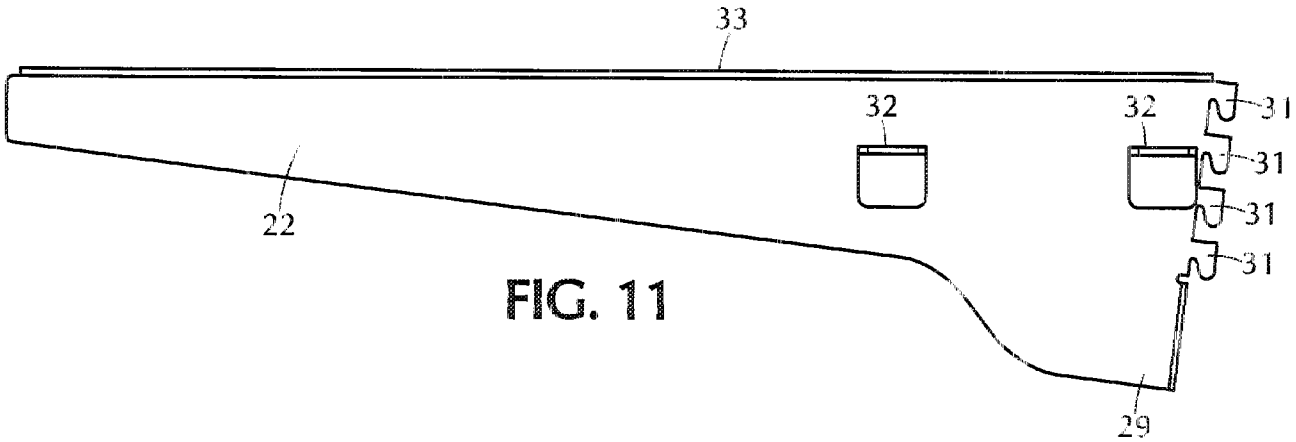
FIG. 11 is a side elevational view of an arm of the frame assembly of FIG. 4.
Figure 13:
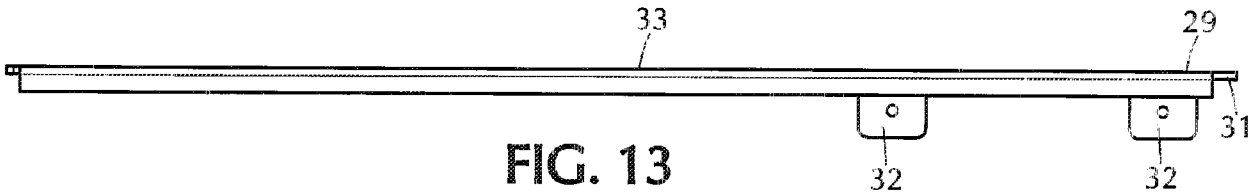
FIG. 13 is a top plan view of the arm of FIG. 11.

Details of the front cross brace 24 are best shown in FIGS. 6 to 8. Brace 24 is generally U-shaped in cross section with a horizontal flange 34 extending rearwardly from one free end to support the lock mechanism as will be discussed hereafter. The configurations of braces 26, 28 and 30 are similar to each other, and are best shown in FIGS. 6, 9 and 10. Each is generally channel shaped in cross section with inwardly projecting lips defining a longitudinally-extending, upwardly facing slot 34 (See FIG. 10).

FIG. 9, showing the structure of the cross braces 28 and 30 that are provided with bolt slots 32 that enable slight adjustment of the spacing of the rear ends arms 22 so that variations in the lateral spacing of the uprights of the gondolas can be accommodated.

The rear ends 29 of arms 22 are formed with conventional hooks 31 that engage the slots of the gondola uprights and, when connected, the upper surface 33 of each arms 22 is inclined sloping downwardly rear to front. In the exemplary embodiment, the inclination of surface 33 is sloped at about five degrees (5°) from horizontal.

The Slide Mechanism

Figures 12, 14:
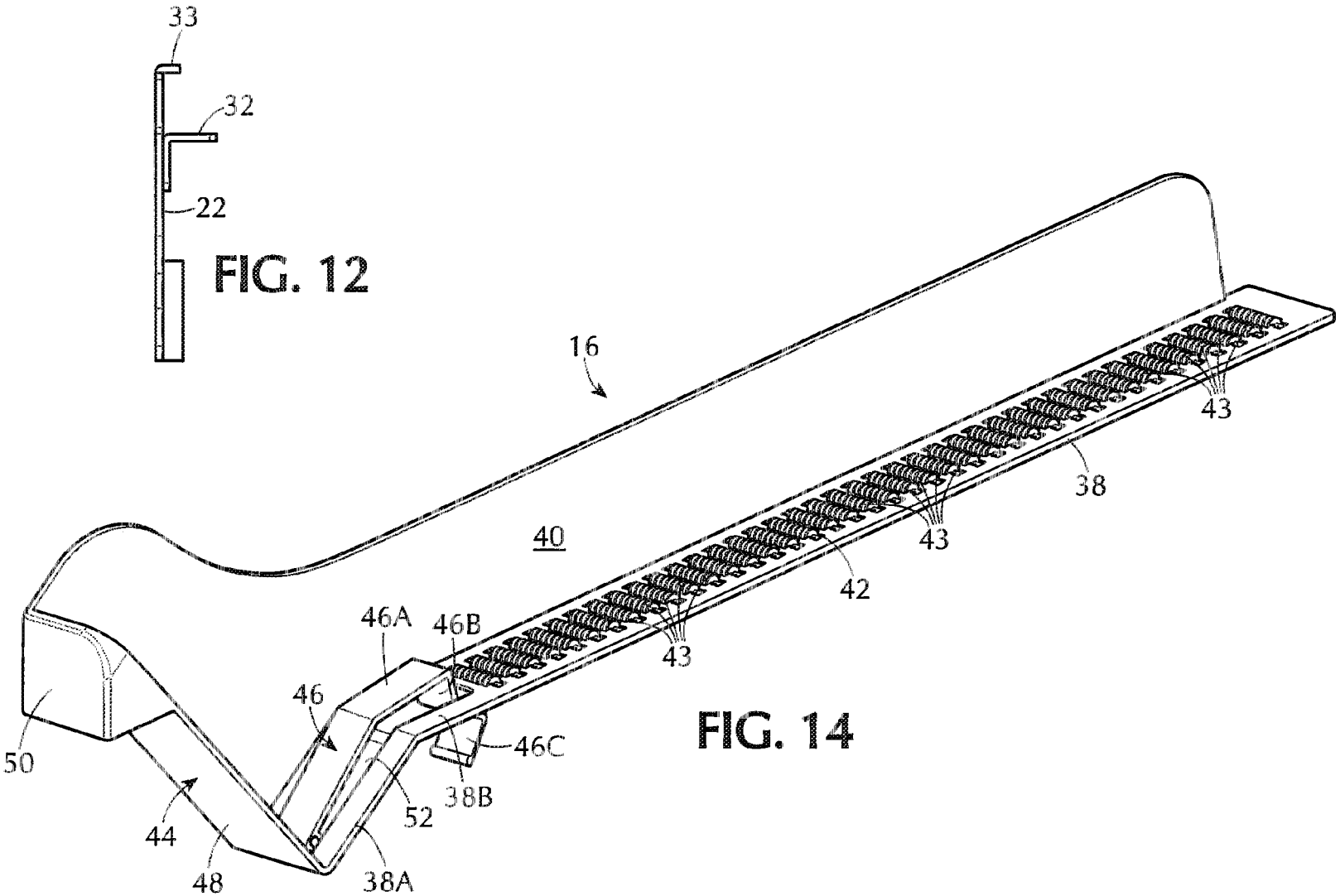
FIG. 12 is a front elevational view of the arm of FIG. 4.
FIG. 14 is an isometric view of a slide mechanism according to the invention.
Figure 14A:
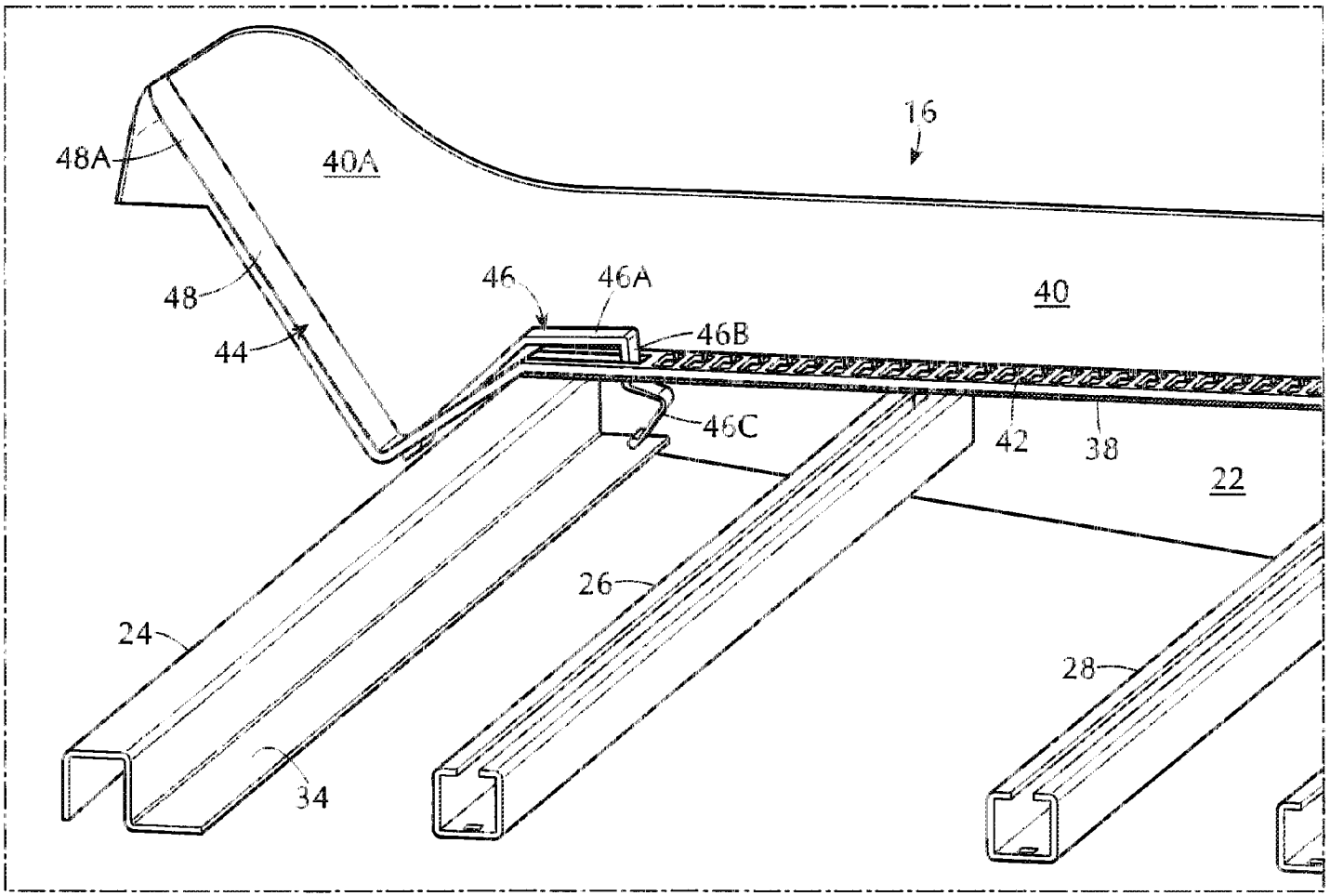
FIG. 14A is an isometric view of the slide mechanism of FIG. 14 supported on cross braces.

With reference to FIGS. 14 and 14A, an exemplary slide mechanism 16 is shown having a deck 38, a divider panel 40, at least one roller assembly 42 made up of individual rollers 43 (rollers not being shown in the deck of FIG. 14A), a first stop structure 44 and a lock mechanism 46 serving as a second stop. The slide mechanism 16 depicted is an end of display slide mechanism in that it has only one deck 38, it being understood that slide mechanisms located intermediate of the display have a deck 38 on both sides of the divider panel 40, with those decks mirror images of each other. There is also a similar mirror-image slide mechanism facing the slide mechanisms 16, from the opposite arm 22, such that cartons, e.g. cartons 20, have the two lateral ends thereof each supported on a respective slide mechanism 38.

In FIG. 14A, the slide mechanism is shown supported on the frame assembly. The divider panel 40, deck 38 and portions of the lock mechanism 46 may be formed as a one piece unitary structure of, for example, clarified polypropylene, or lock mechanism 46 may be a separate piece connected for rotating movement near its forward end to the rest of the slide mechanism 16, as by clipping to a laterally extending pin. The first stop mechanism 44 is formed by a wall 48 extending laterally from the divider panel 40 transversely of the deck 38. The front end portion 40A of the divider 40 and the upper portion 48A of first stop wall 48 have heights that are greater than the height of the product being displayed to thereby create a return area for product, i.e., so that the cartons can be stacked resting diagonally on stop surface 44. The outer surface of wall portion 48A is configured to provide a surface 50 to serve as a price rail or a location for other consumer information or for signage. Where the slide assembly 16 is in the middle of the display, i.e., with another mirror image slide assembly on the other side of wall 40, the size of surface 50 is doubled as a signage area 51, as seen in FIG. 2.

The portion 38A of the deck at the front end of the display is angled downwardly approximately 45 degrees from horizontal in the exemplary embodiment to create a product tilt area that greatly enhances the ergonomics of the display system. Portion 38A of the deck as well as contiguous segment 38B of the main deck portion define a slot 52. Lock mechanism 46 includes an elongated arm 46A which may be formed integrally of the deck, but is movable, preferably pivotable about an axis near its forward end with respect to the deck, a wall 46B (FIG. 14A) serving as a second stop and a spring 46C that biases the arm upwardly when it is not pressed down. The spring 46C extends from the free end of the arm 46A to the flange 34 of cross brace 24 (see FIG. 14A). When downward force is applied to arm 46A by a product resting thereon, the arm 46A is forced downwardly, and out of the way so as to clear the product travel path for cartons 20 to have forward movement past the second stop 46B and toward wall 48 the first stop.

Figure 14B:
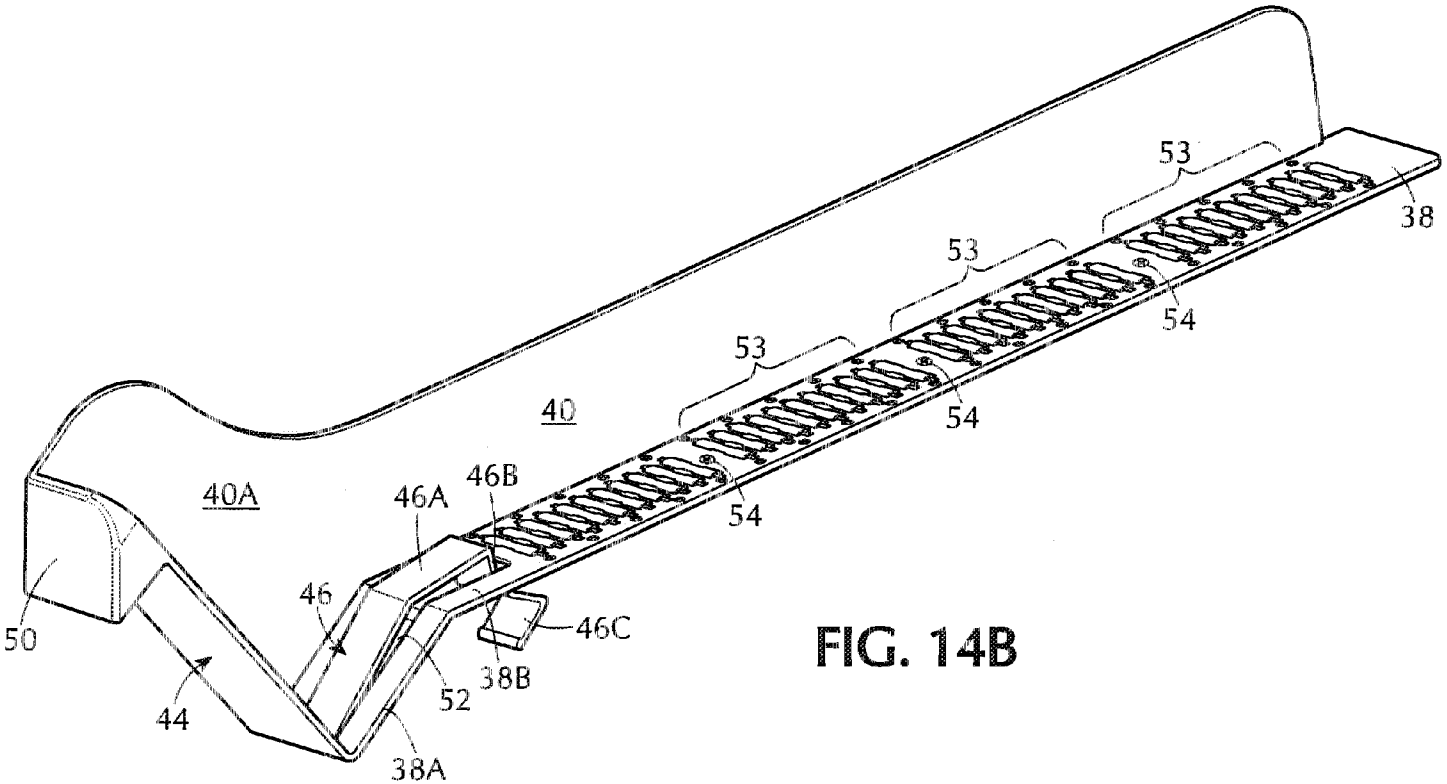
FIG. 14B is an isometric view of an alternate embodiment of a slide assembly similar to FIG. 14.
Figure 21:
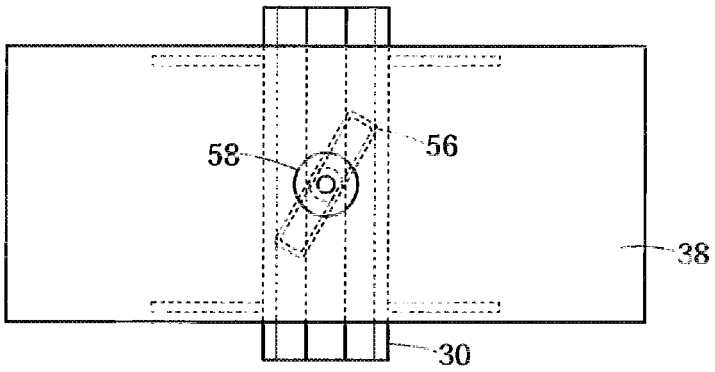
FIG. 21 is a fragmentary plan view of a structure securing the slide assembly to the frame.
Figure 22:
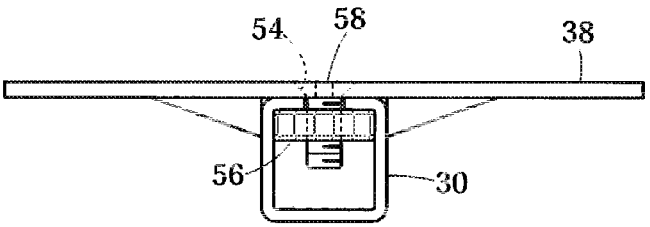
FIG. 22 is a side view of the structure of FIG. 21.

With reference to FIG. 14B, in an alternate embodiment the deck 38 includes a plurality of sets of rollers 53. Between the rollers 53, the deck 38 has mounting openings 54 therein spaced along its length which may be aligned with cross braces similar to cross braces 26, 28 and 30 between arms 22. Suitable fasteners, such as wing fastener cams 56 as depicted in FIGS. 21 and 22, have hex head bolts 58 supported in openings 54. In one orientation, cams 56 are received through slots 34 of the cross braces. When rotated, the cams engage the interior walls of the cross braces, and bolts 58 are tightened so as to secure the deck 38 to the associated cross brace 26, 28 or 30. In this way the slide mechanism can be shifted laterally as necessary to accommodate products of differing size.

In FIGS. 15-20 the operation of the lock mechanism and the tilt region of the display assembly is depicted in sequence during product loading.

Figure 15:
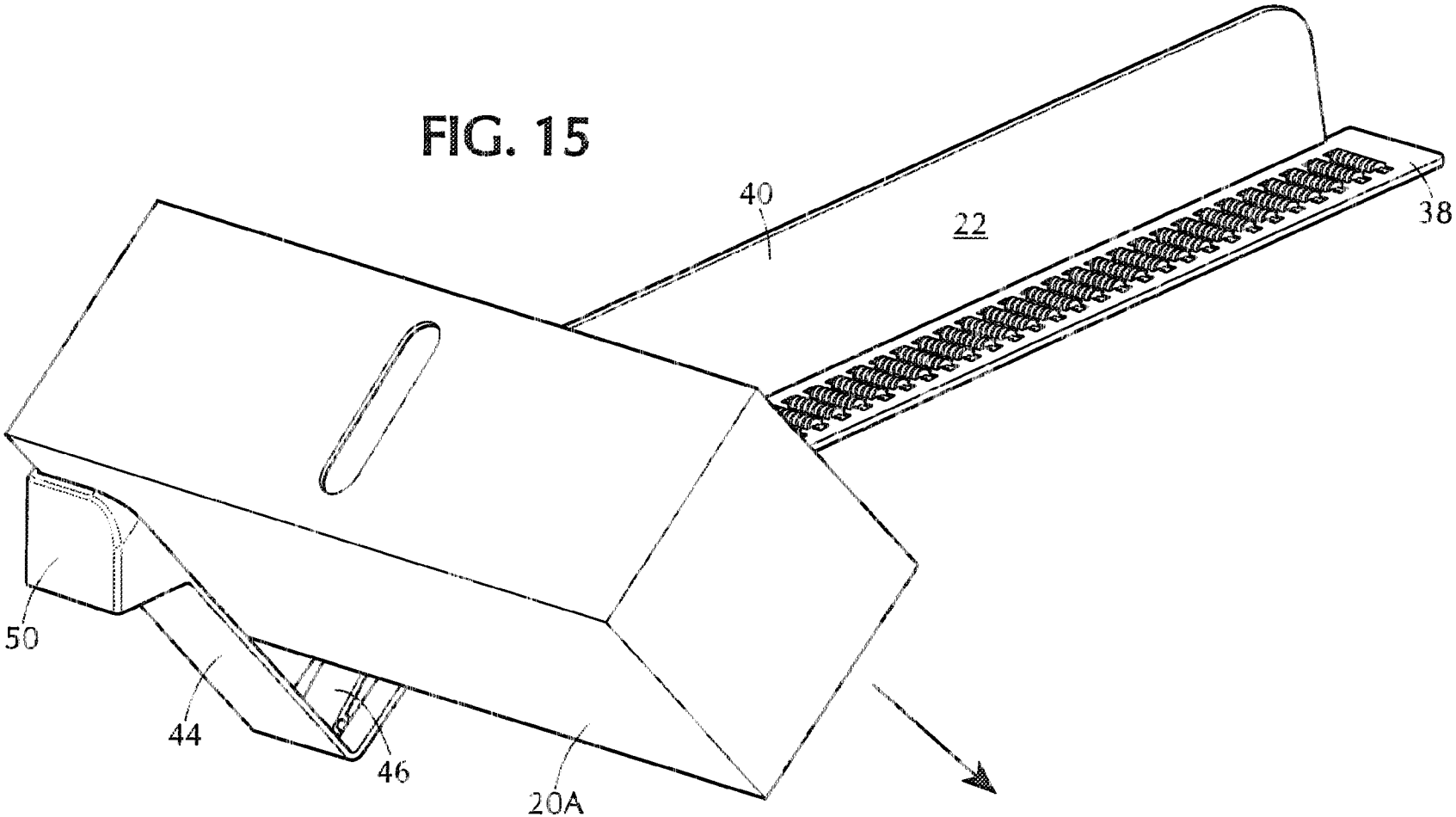
FIGS. 15-20 are isometric views illustrating sequence of loading products on the slide mechanism of FIG. 14.
Figure 16:
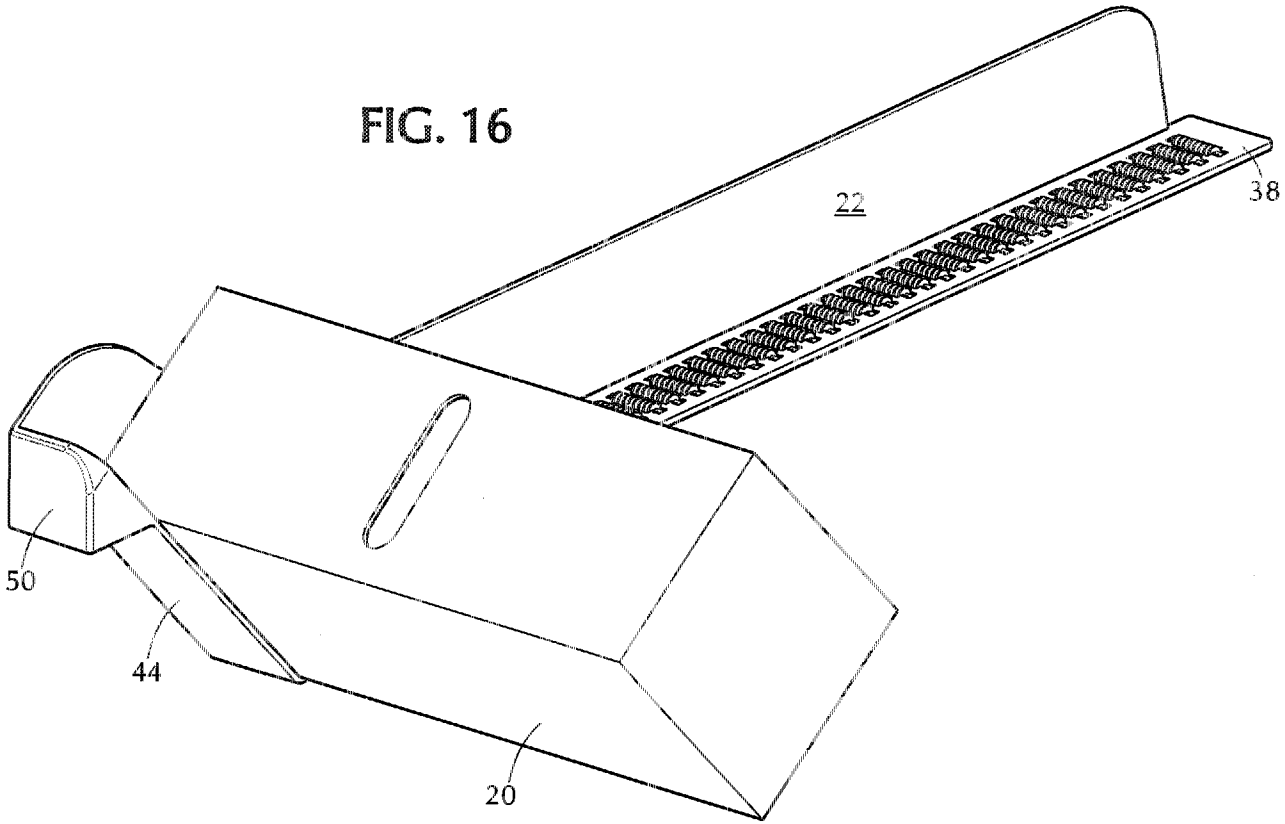

In FIG. 15, the first carton 20A is placed in the front of the rack 22 behind front wall 50 so as to rest on diagonal wall 4 and latch arm 46. As seen in FIG. 16, once resting on this latch, carton 20A has one end thereof on the left hand rack assembly 16. It will be understood that the carton has a right end also resting on the mirror-image rack assembly that faces the rack shown in FIG. 16, so that the carton 20 is supported at both ends of its extension on these two opposing sliding structures for sliding movement thereon. The two rack assemblies are spaced so that the walls 40 allow enough clearance for the cartons to slide forward and rearward on the slide assemblies of racks 38, but this clearance is small enough that it is not possible for the carton to twist so that it could slide off between the racks 38.

Figure 17:
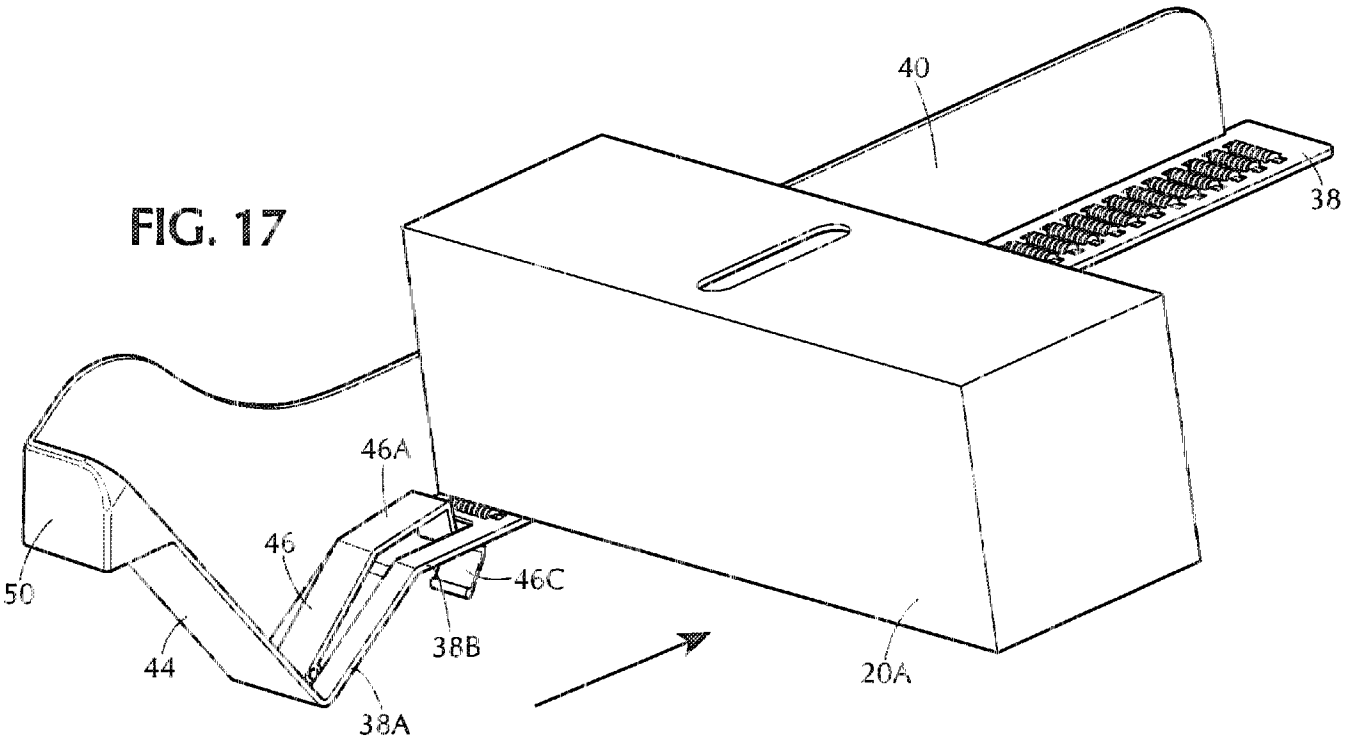

As seen in FIG. 17, the person loading the carton then pushes the carton 20A rearward onto the rollers of the deck 38 and rearward of the latch mechanism 46 so that the spring 46C pushes the latch portion 46A up above the deck 38.

Figure 18:
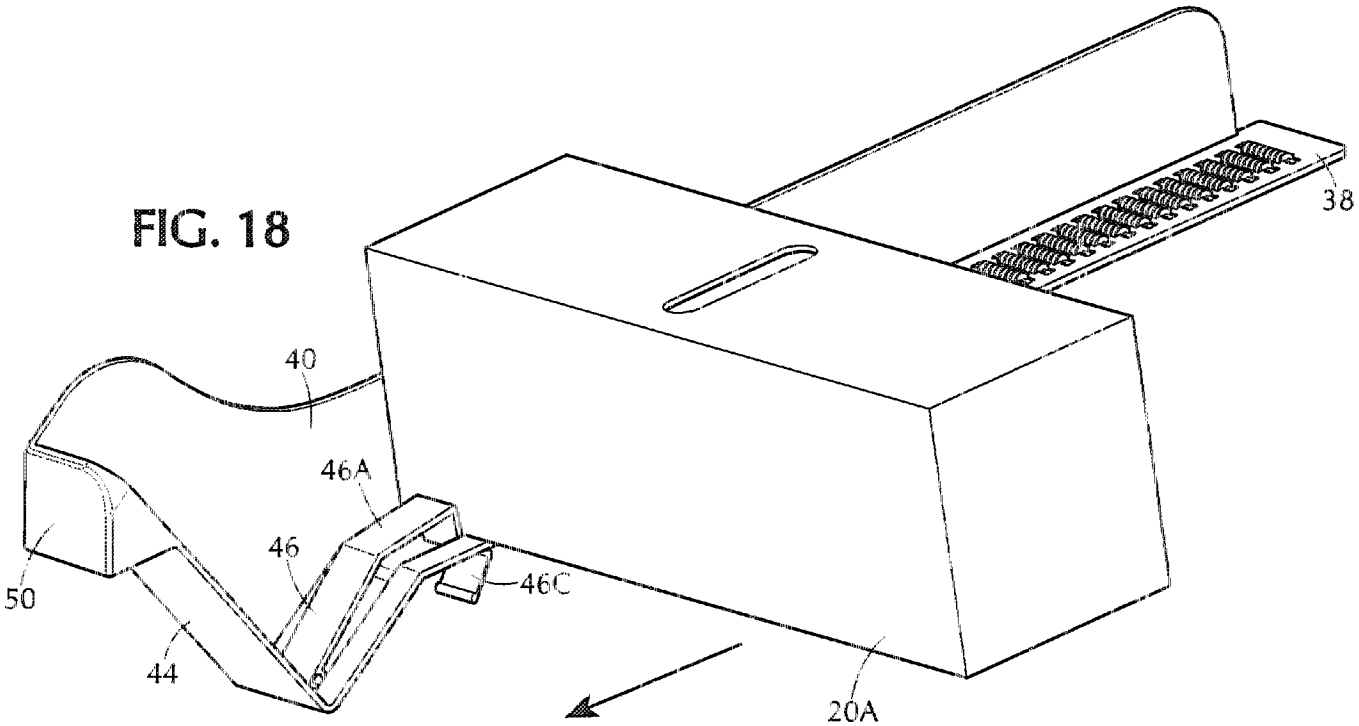

In FIG. 18, the box is then released as the stock worker goes to pick up the next carton, and due to the tilt of the deck 38 and the roller support, carton 20A slides back downward towards the front of the rack 16 coming to rest by a button with the rearward facing surface 46B of the latch structure 46, preventing further movement forward of the carton 20A. There is, as a result, a space in the front portion above the stop wall 44 that allows loading of another carton.

Figure 19:
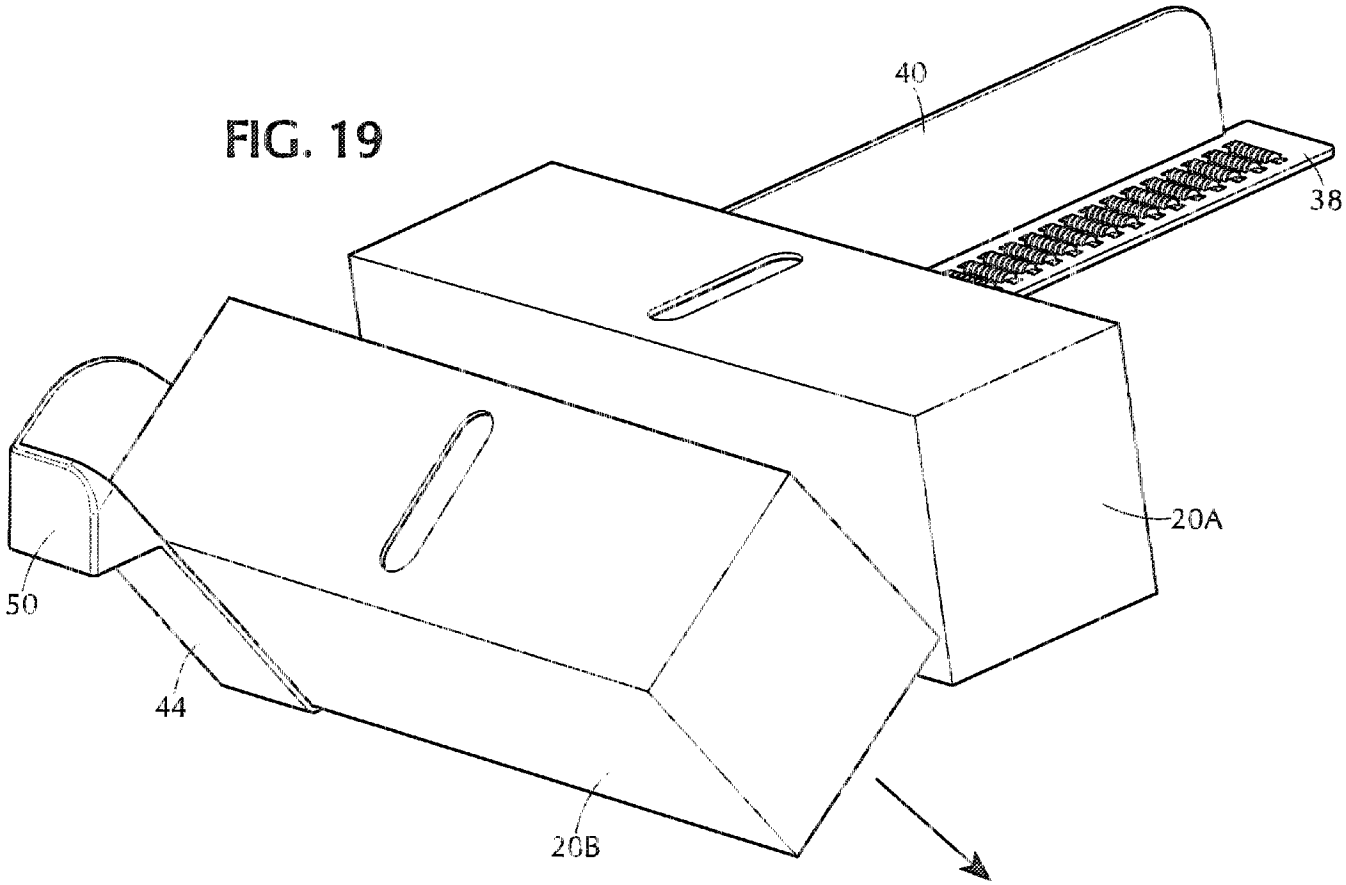

As seen in FIG. 19, a second carton 20B is then loaded into this space, and it can be pushed rearward until the deck 38 is completely covered by cartons. With reference to FIG. 19 it will be appreciated that the tilt and lock mechanism dimensions are such that the first loaded product (as well as the second loaded product) overlaps a portion of the arm 46A so that if the second loaded product (as shown) is removed the first loaded product will slide toward the first stop mechanism 44 and will assume a tilted condition.

Figure 20:
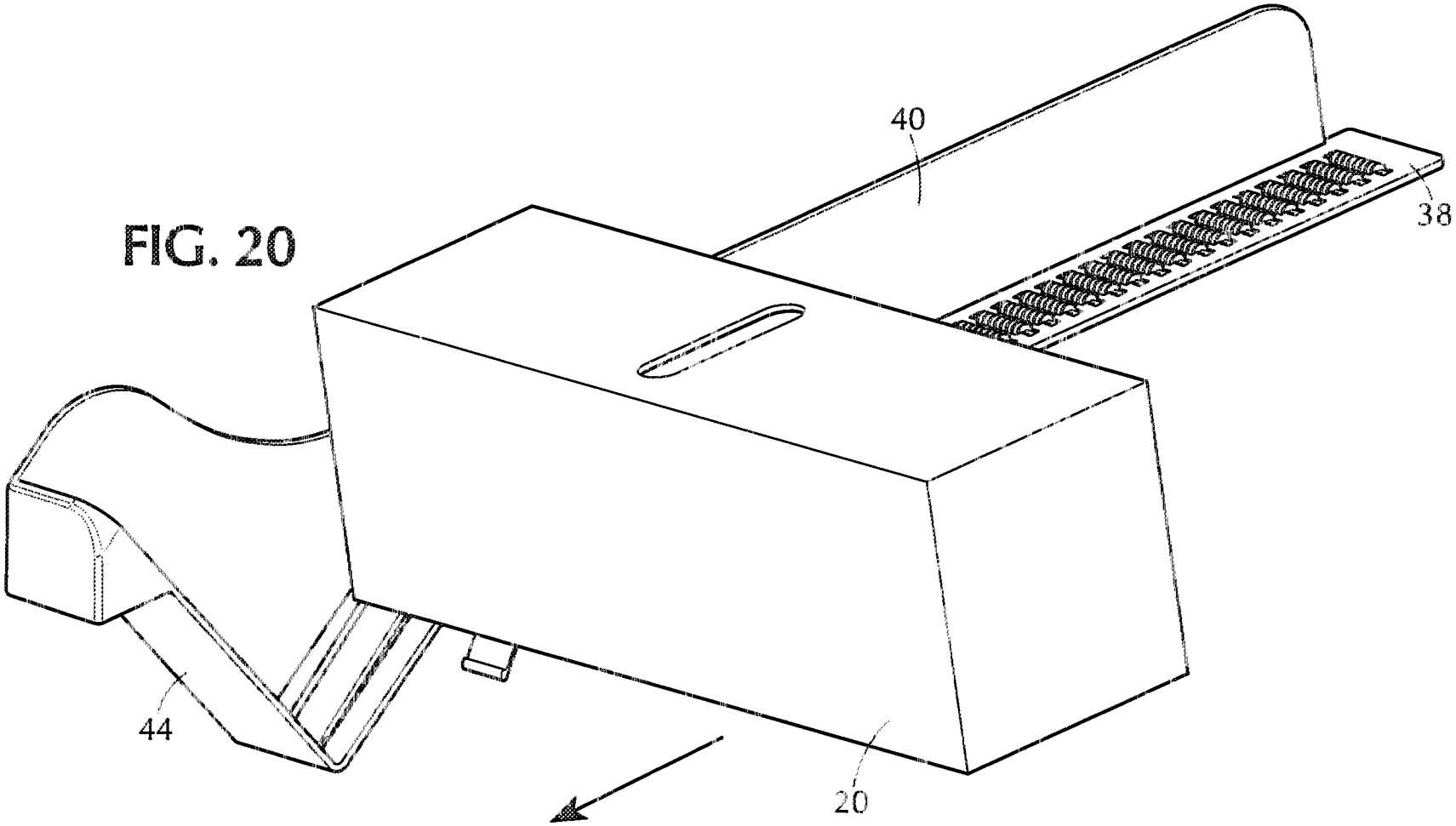

Referring to FIG. 20, where the latch 46 is depressed, the carton 20 on the rack 38 is permitted to slide fully forward, coming to rest on wall 44 in a diagonally supported position. The front structure 44 extends far enough up that it can support a second carton 20 when placed on top of the first carton 20 by a stock person or shopper placing the carton back on the rack.

Figure 23:
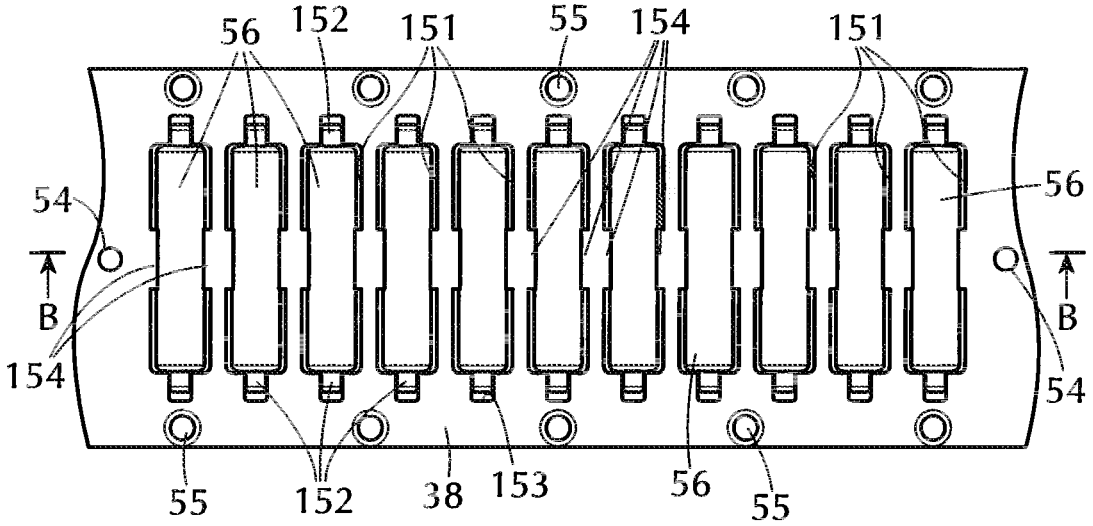
FIG. 23 is an enlarged fragmentary plan view of a portion of the deck of an alternate embodiment of slide mechanism with rollers affixed therein.
Figure 24:
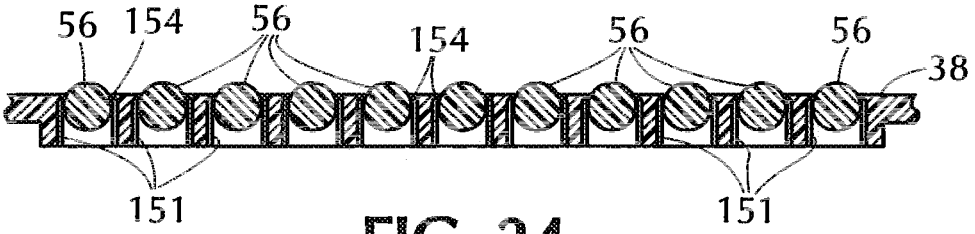
FIG. 24 is a sectional view taken along the line A-A of FIG. 23.

Details of a roller assembly and a method for assembling such are depicted in FIGS. 23 to 25C. FIGS. 23 and 24 depict rollers 60 mounted along a length of a deck 38.

It will be noted that in FIG. 23 that the deck 38 of FIG. 23 includes a series of openings 54 along and bordering the rollers 56. Each roller 56 is supported in a respective recess 151 with an axle 152 at each end of the roller 56 supported in narrowed end areas 153 of recess 151 so that the roller 56 can rotate when in the recess when loaded by a carton thereon. The recess 151 may extend completely through the deck 38, but the end areas 153 support the roller axles and therefore do not go fully through the deck 38, but provide a bottom of the recess 153 on which the axle 152 rotatively rests.

Figure 25A:
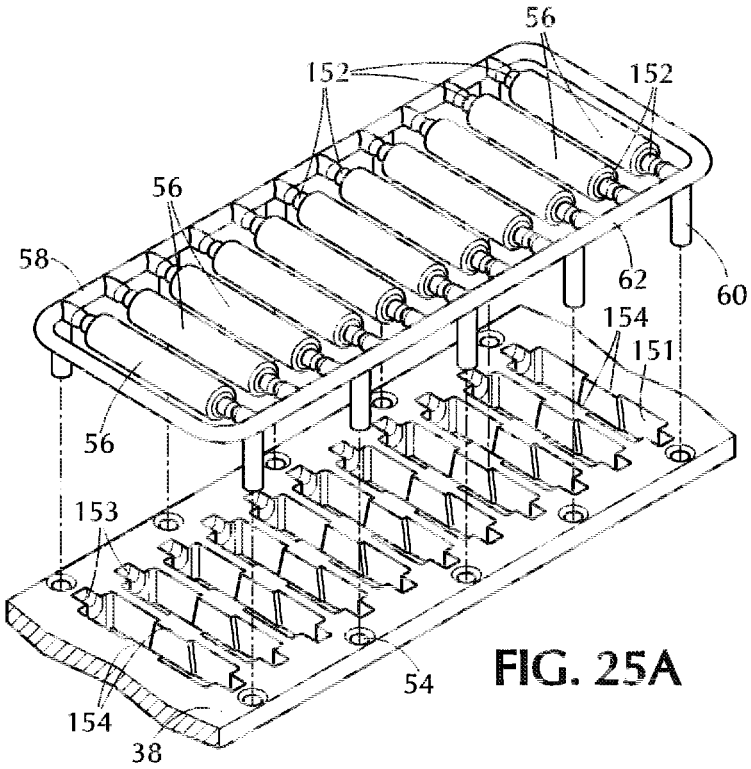
FIG. 25 is a schematic illustration of a sequence of an assembly in isometric view, illustrating a manner of assembly of the rollers into the deck of the slide mechanism.
Figure 25B:
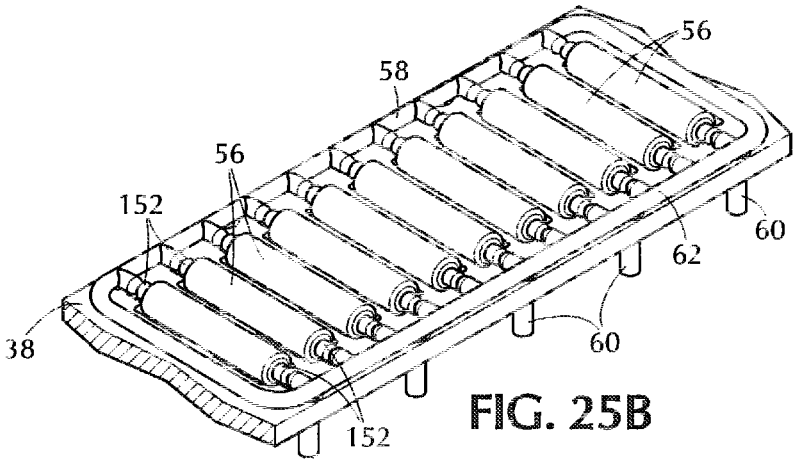
Figure 25C:
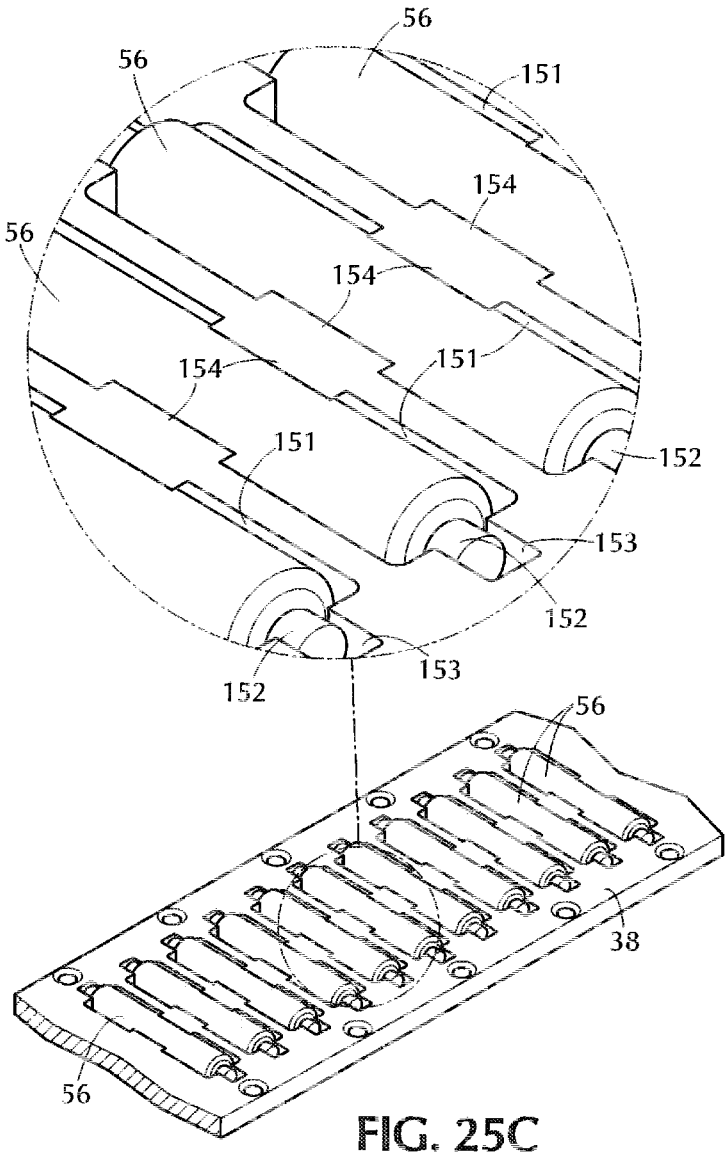

One method of assembling the roller 56 into the deck as illustrated in FIGS. 25A to C as a two-step process. First, the rollers 56 are molded as a part of a unitary tree 58 having guide pins 60 projecting downwardly from runner 62. As best seen in FIG. 25B, pins 60 are guided into the openings 55 of the deck 38 to the pre-pressed stage as illustrated. Thereafter, the rollers 56 are pressed into the slots of the deck 38 past and to be entrapped by tongues 154, with the runner 62 and pins 60 severed during the pressed operation, resulting in the assembled roller set shown in FIG. 25C.

Figure 27:
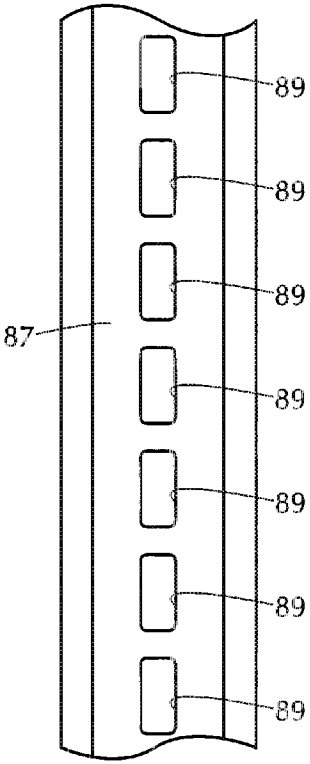
FIG. 27 is a front view of a portion of a post of the rear of the gondola assembly of FIGS. 1, 2 and 3.
Figure 26:
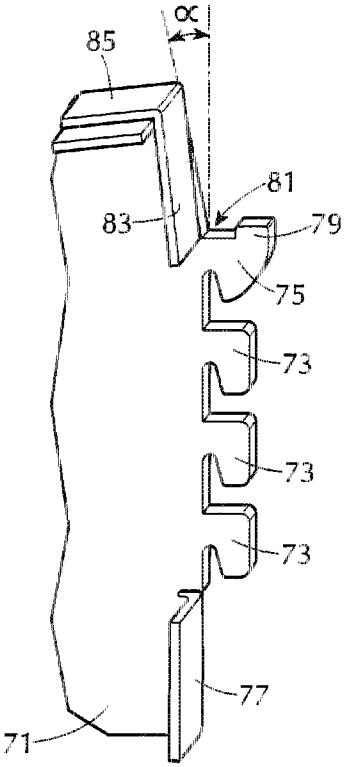
FIG. 26 is an isometric view of a rear portion of a side arm assembly of an alternate embodiment of the invention.
Figure 29:
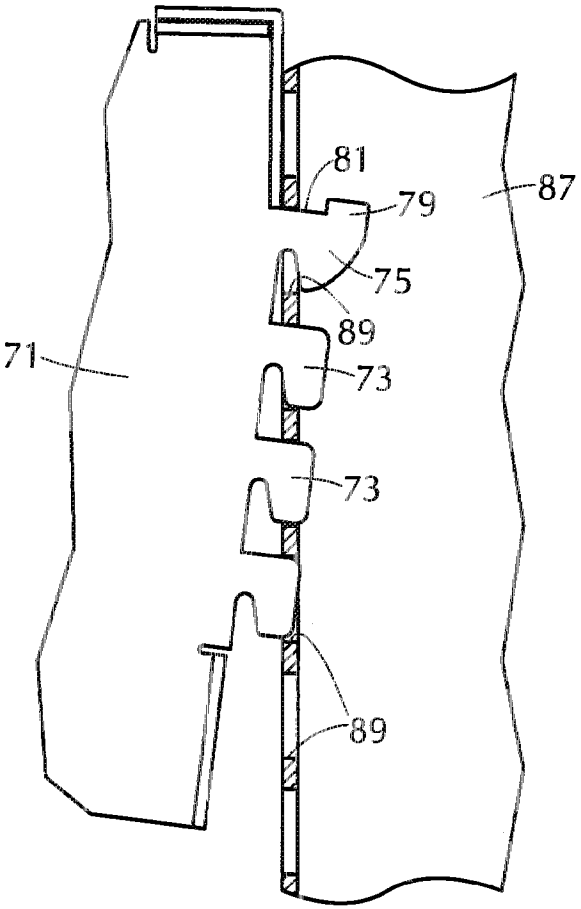
FIG. 29 is a view as in FIG. 28 showing the side arm support in the process of being removed from the post.

FIG. 26 shows an alternate embodiment rear portion 71 of arms 22. The rear portion 71 has a plurality of rearward facing hooks 73 and 75 that co-act with slots 89 (see FIG. 27) in a vertical post 87 to the rear of each arm 22 where the vertical post has a configuration shown in FIG. 27. Arm 22 is mounted onto the post slots 89 by angling and inserting the hooks 73 and 75 into the slots 89 with the arm tilted up to permit clearance of the upper portion 79 into the slots 89.

Figure 28:
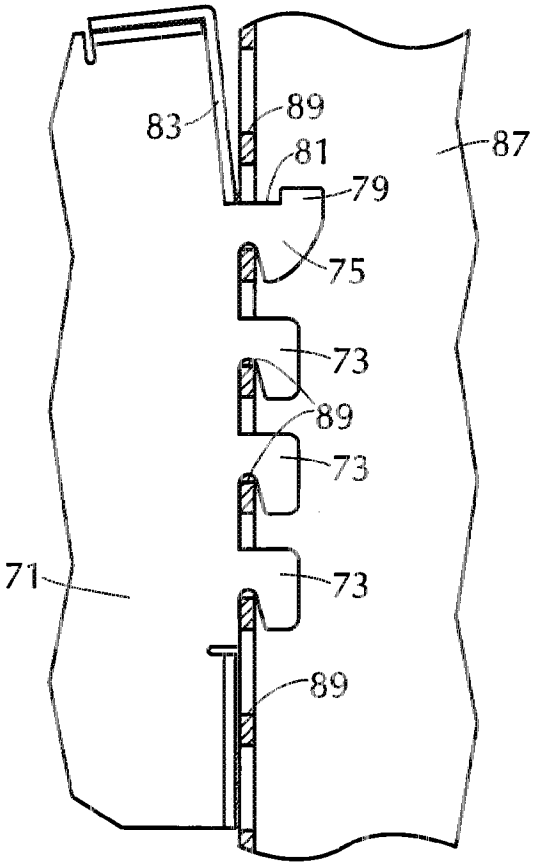
FIG. 28 is a cross sectional view through the post of FIG. 27 showing the alternate embodiment of arm support secured therein.

As best seen in FIG. 28, when inserted, the hooks 73 and 75 have lower portions with recesses that hang over the adjacent portions of the slotted beam of the gondola. To remove the arm 71 from the vertical post 87, the arm is first lifted vertically so that the lower ends of the hooks 73 clear the associated portions of the post and can pass forward through the slots 89. Upper hook 75, however, has vertically extending portion 79 which creates a recess 81 that fits over the slot at the edge of the slot 89 at this point and prevents the arm 71 from being withdrawn forward. Rather, the arm has to be elevated at an angle relative to the post to allow the upper portion 79 to pass through the slot 89. To allow this, a clearance portion 83 is provided at an angle $\alpha$ relative to the rear edge of the arm 71, and this allows for angulated vertical motion of the arm 71 so that it can be withdrawn from the post. The additional structural height of portion 83 results in the top surface portion 85 of the arm being higher than the top hook 79.

As with the previous embodiment, the upward surface 85 slopes downwardly and forwardly from the rear end of the arm 71 at approximately five degrees (5°).

Figure 30:
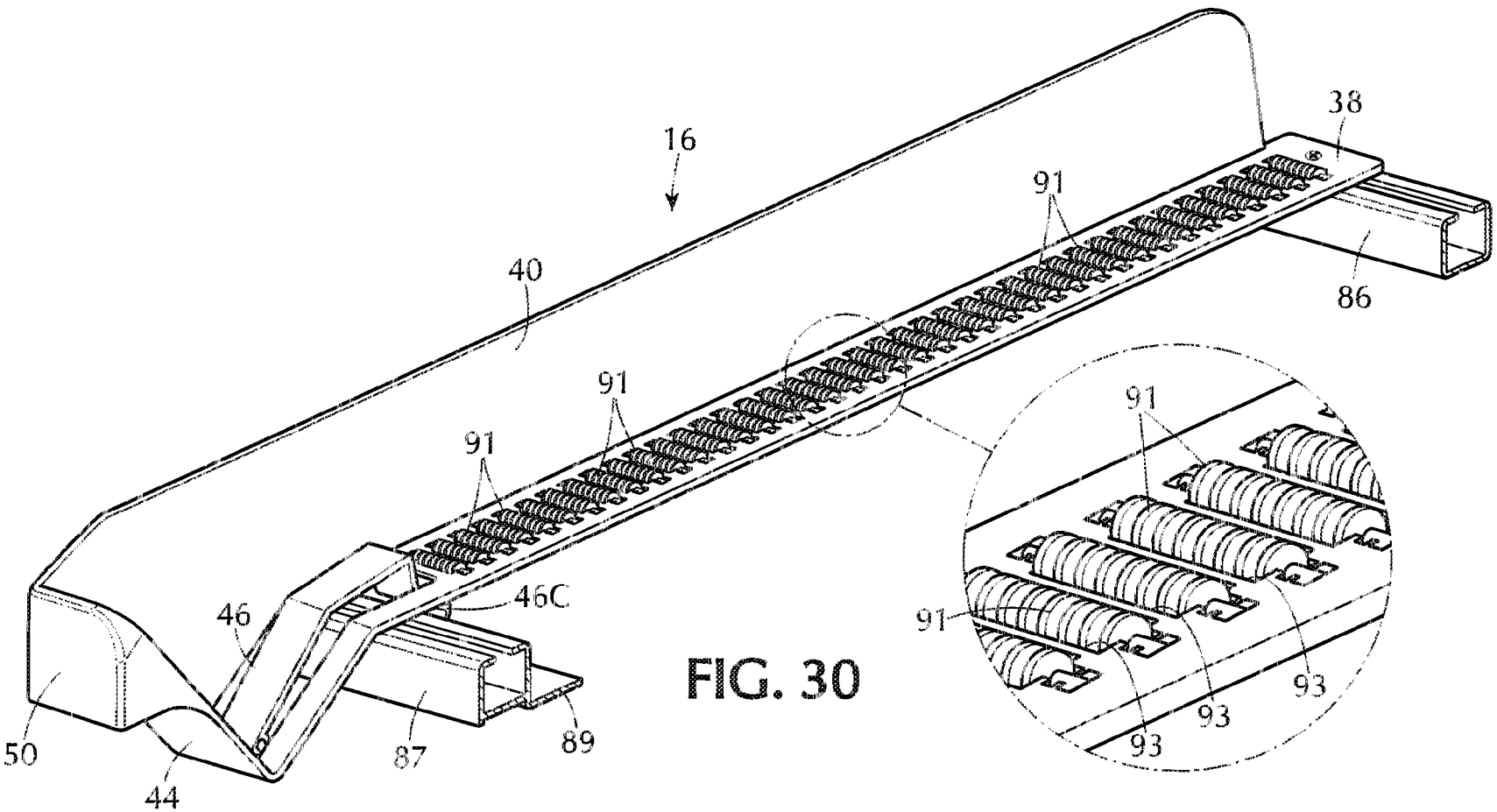
FIG. 30 is an isometric view of another alternate embodiment of a slide assembly of the invention.
Figure 31:
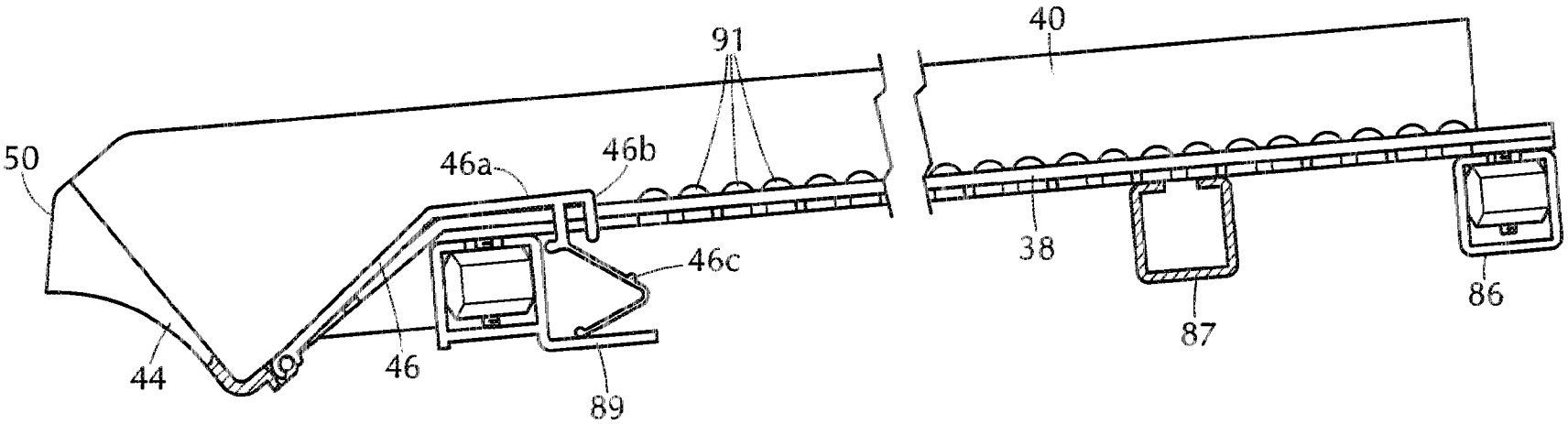
FIG. 31 is a side view of the slide assembly of FIG. 30.

Referring to FIGS. 30 and 31, an alternate embodiment of sliding rack is shown, with equivalent structures bearing the same reference characters as the embodiment of FIG. 14. The slide mechanism 16 of FIG. 30 is one of a pair of mirror image slide mechanisms, each having a deck 38 supported on crossbeams 89, 86, which are similar to crossbeams 26 and 28, and optionally additional crossbeams between associated support arms (not shown). The deck 38 extends horizontally slopingly downward at about five degrees from the rear of the gondola adjacent a wall 40 which extends vertically therefrom and rigidifies the structure. The wall 40 also serves as a divider between the deck 38 on one side and a similar mirror image deck on the other side of wall 40 (not shown) where the sliding structure is in the middle of the device and has cartons on both sides of the dividing wall 40. Deck 38 extends towards the front end 50 of the sliding structure. At the front end, the sliding structure is provided with a latching portion 46 that is movably or pivotally supported at its front end in a recess in the body of the sliding structure for pivoted movement by a pivoting connection or clip around a transverse pin or cylinder 96 (see FIG. 34). This latching structure 46 allows for loading and unloading of the display in an ergonomic fashion.

The deck 38 has therein a series of parallel apertures 93, each receiving and supporting therein a respective roller 91. The roller is supported in the recess 93 for rotating movement so as to provide a reduced friction interaction when cartons are placed on the deck 38, so that the cartons by force of gravity roll down the inclined surface of the deck 38 towards the front end 50 of the sliding structure. When allowed to proceed all the way to the end, the carton supported on the deck 38 slides past the catch 46 and then rests in a diagonally oblique position resting on front wall 44. The shorter wall 44 of this alternate embodiment may permit stacking of only one carton on wall 44.

Referring to FIG. 31, the latch structure 46 includes a spring portion 46C that extends downward to engage a flange 89 of the crossbar of the surrounding support structure. This spring 46C is generally a flexible plastic component of the plastic part 46 and causes a biasing upward force to push the upper surface of part 46 above the level of the rollers 91 so that the latch 46 abuts and prevents forward movement of cartons resting on the rollers 91 until it is depressed against the biasing of spring portion 46C pressing on flange 89.

Figure 32:
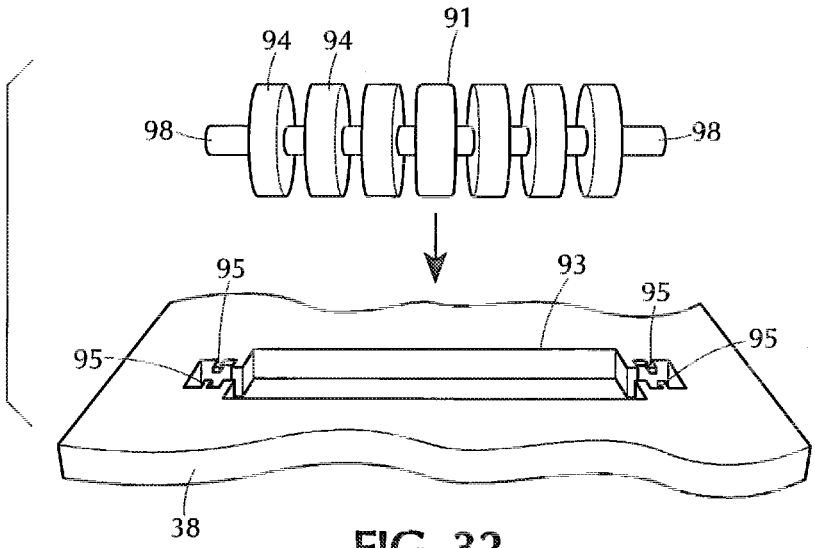
FIG. 32 is an exploded view of a detail portion of the slide assembly of FIGS. 30 and 31 showing a roller removed from the associated recess.

Referring to FIG. 32, each roller 91 comprises a central shaft extending laterally and a plurality of circular disks 94 which define annular recesses 96 therebetween. The axle 98 of the roller is received in the recess 93 in deck 38 so that the roller is supported and spins with a portion of the roller extending above the deck 38. The roller is secured in the recess by extending protrusions 95 that are slightly deformable to approximately four thousandths of an inch so as to provide a securing clipping reception of the roller 91 by its axels 98 in the sides of the opening 93. The recesses 961 rollers 91 allow for drainage of liquid in the event of a spill or rupture of liquid from can in a carton, which can just fall through the open bottom of recess 151 instead of pooling and drying so as to impair rotation of the roller 91 n space 151.

Figure 33:
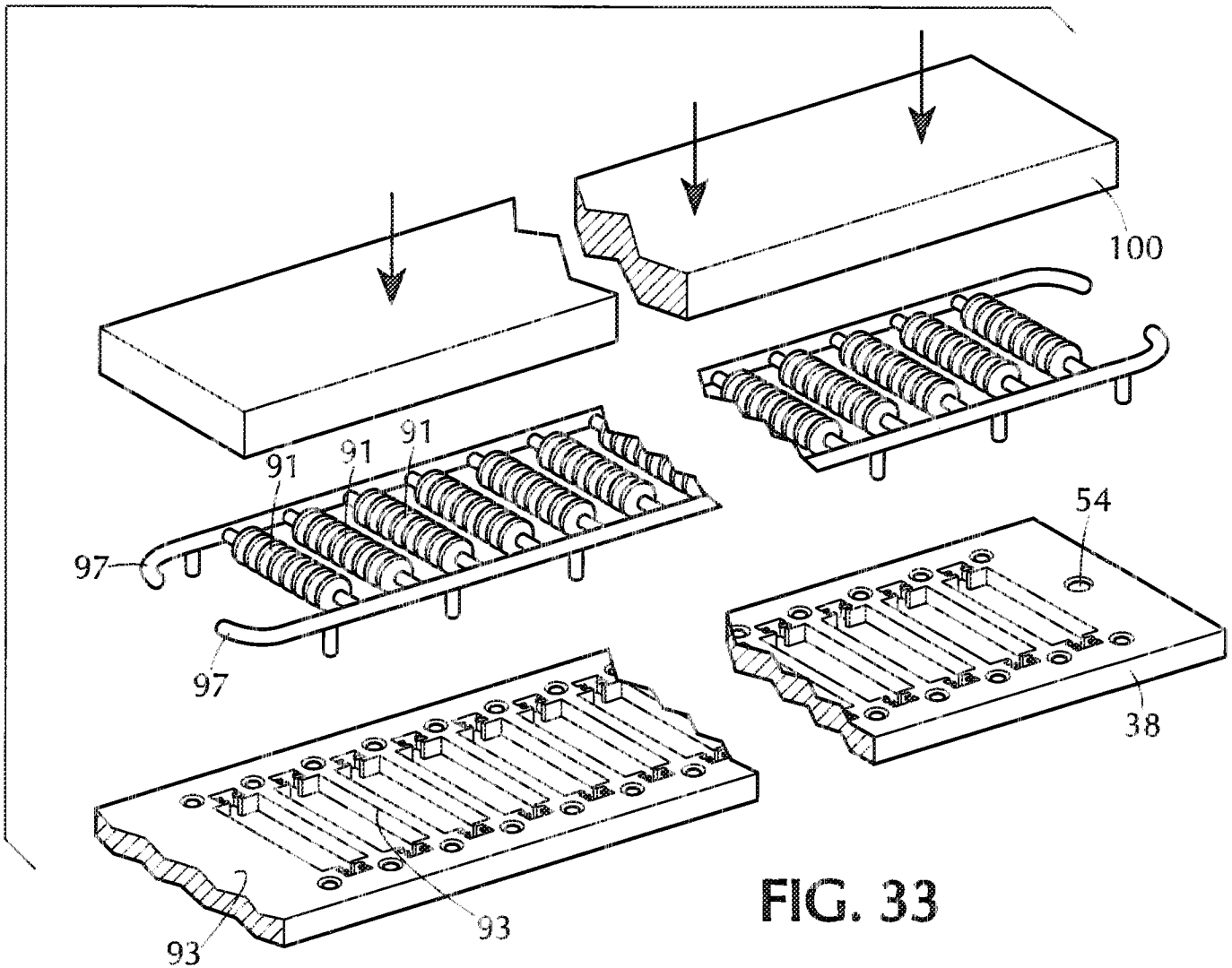
FIG. 33 is a schematic illustration of a method of installing the rollers in the slide assembly of FIGS. 30 and 31.

Referring to FIG. 33, method is shown for efficiently loading the rollers into the deck 38. In this method, the deck 38 is first prepared with a plurality of openings 93 with appropriate slightly deformable nubs 95 that are configured to entrap the axle 98 of rollers therein so that the rollers spin freely but cannot come out of the recess 93. The deck 38 includes a plurality of alignment apertures 102 along the deck 38. The rollers are fabricated as part of a tree carrying as many rollers 91 as are required for an individual deck 38, in the preferred embodiment this being approximately 40 rollers. The tree itself has downwardly extending alignment posts 104 and attached rollers 91 on the tree, which includes side bars 97 that are breakably connected to the ends of the axles 98 of the rollers 91. When the posts 104 are inserted into the openings 102 the rollers 91 align each with a respective aperture 93. When so aligned, an arbor press such as is manufactured by Masters and Carr and indicated schematically at 100, is applied above the rollers 91. This arbor press 100 simultaneously presses down on all the rollers 91 in the tree so that they snap past protrusions 95 and break away from the side bars 97 of the tree, becoming entrapped rotatably within each its respective aperture 93. This manufacturing approach greatly reduces the manpower required for assembling this type of structure with a sliding series of rollers.

Figure 34:
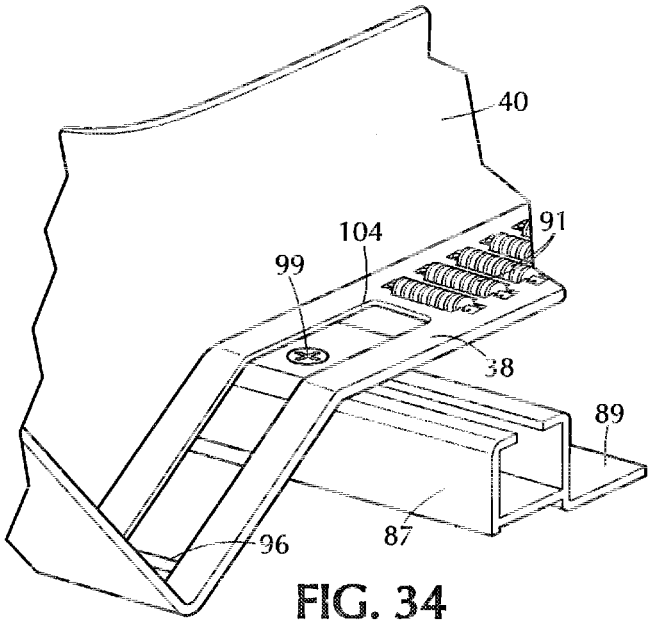
FIG. 34 is a detail view of a connection of the slide assembly of FIGS. 30 and 31 to a cross bar.

Referring to FIG. 34, latch 46 is pivotally supported about a horizontally and laterally extending pivot pin 96 inside the recess 104 in the deck 38. The connection to the pivot pin is preferably a snap connection so that the latch 46 may be snapped off pin 96 and withdrawn from the recess 104, exposing an access to the connection of the deck to the front cross member 89. The deck has attached thereto a connection flange having an aperture therein through which a bolt 99 is inserted extending downwardly into the upward groove in the channel shape of the cross member 89. A similar connection is provided at the rear of the deck 38 to cross member 87.

Figure 35:
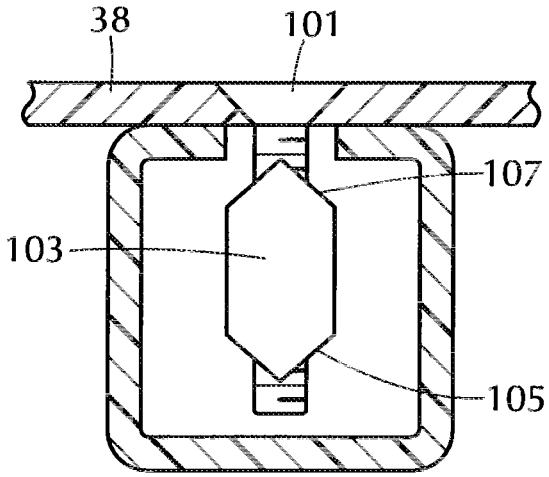
FIG. 35 is a cross section view through the supporting cross bar of a connector of the slide assembly of FIGS. 30 and 31 to the cross bar.
Figure 36:
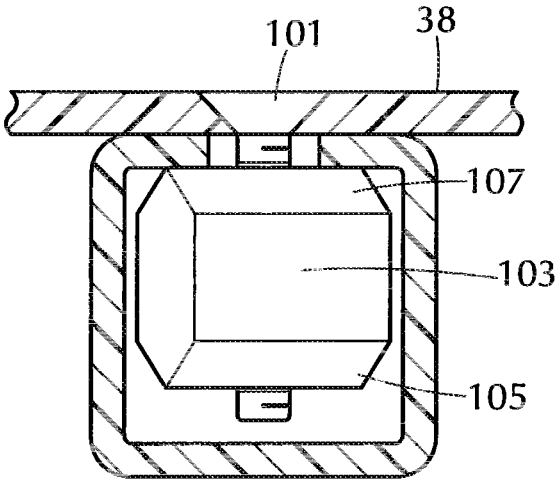
FIG. 36 is a view as in FIG. 35 showing the device secured.

Referring to FIGS. 35 and 36, the deck 38 has a counter sunk aperture therein through which bolts 101 extend downwardly into an opening or slot in the upper portion of cross member 89. The lower end of bolt 101 is readily received into connection member 103. Connection member 103 has generally a hexagonal shape in cross section, with a tapering lower portion 105, and a tapering upper portion 107. This structure allows for the connector 103 to be inserted easily into the slot in the cross member 89. It also allows for easy withdrawal from the slot once rotated to the position shown in FIG. 35.

Once inserted, the bolt 101 is turned and the connector portion 103 rotates therewith until it is jammed between the sidewalls of the channel member 89. At that point, the threads of the bolt 101 begin to tighten the connector and it is drawn upward, pressing the upper flanges upward to securely fasten to the deck to the cross member 86 or 87.

When removal is desired, the reverse process is undertaken, with the bolt 101 rotated the other way to loosen the connection, and the tapered upper portion 107 allows for easy withdrawal of the connection member 103 from the channel of the cross member 89.

Referring to FIGS. 38-48, operation of an exemplary sliding rack system according to the invention is illustrated. The rack includes a sloping deck portion 150 with a surface that allows movement such as by rollers 155 upwardly disposed therefrom. The slope of the deck 150 is normally about five degrees (5°).

The deck is also associated with a movable latch 153 which includes an upward surface portion 155 that can be depressed by a product being thereon, and a rearward facing abutment portion 157 that faces rearward and when the latch 153 is elevated will block the movement forward of products resting on the rollers 155. The front end of the rack 150 is connected to a tilted support structure 151 which supports the end of the box resting thereon at about a forty five degree angle for easy viewing and withdrawal by a customer. The width of the space receiving the cartons Information Disclosure Statement sufficient to allow forward and rearward movement on the slide with slight clearance on either side, but not enough to allow twisting of the carton on the slide to the degree where the carton could fall off the sliding mechanisms.

Figure 38:
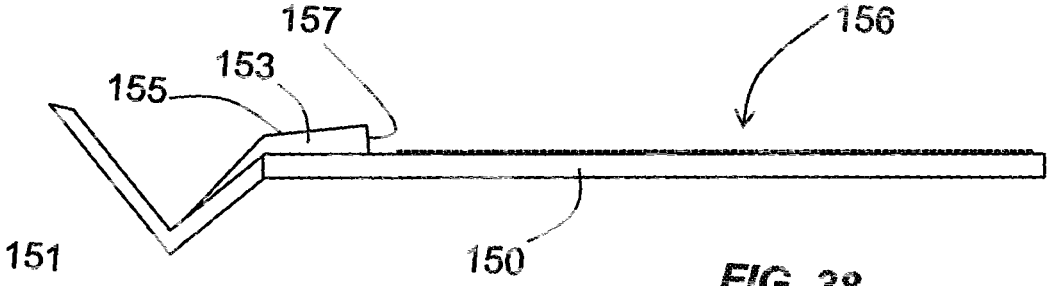
FIG. 38-FIG. 48 are side schematic views of a slide assembly according to the invention showing loading and unloading of the rack.

Latching structure 155 is preferably pivotably connected at its forward end to rotate at least a short distance between an elevated position shown in FIG. 38 and a lower position where the stop portion 157 is below the level of the rollers 155. This rotation is preferably biased by a spring by a spring such as part 46C in previous embodiments, or it may also be obtained by simply a counterweight on the other side of a pivot structure which is not shown in present figures. A variety of other methods may be used for urging the latch structure upward so that the default position is with the abutment structure 157 facing rearward and preventing movement of the product forward.

Figure 39:
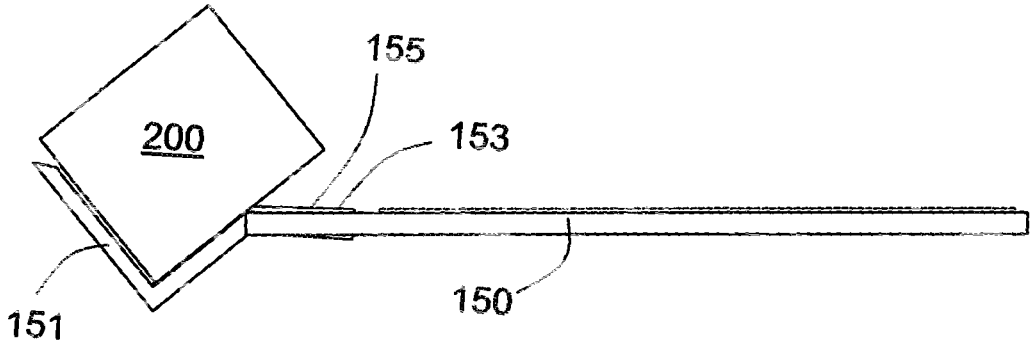

Referring to FIG. 39, when the stock person loads a first product 200 onto the rack 150, it is usually placed in the forward position resting on end portion 151. In this position, the first article, usually supported on two laterally spaced racks 150 each supporting a respective end of the box 200, the box 200 rests on the upper surface 155 of latch 153 and presses it downward.

Figure 40:
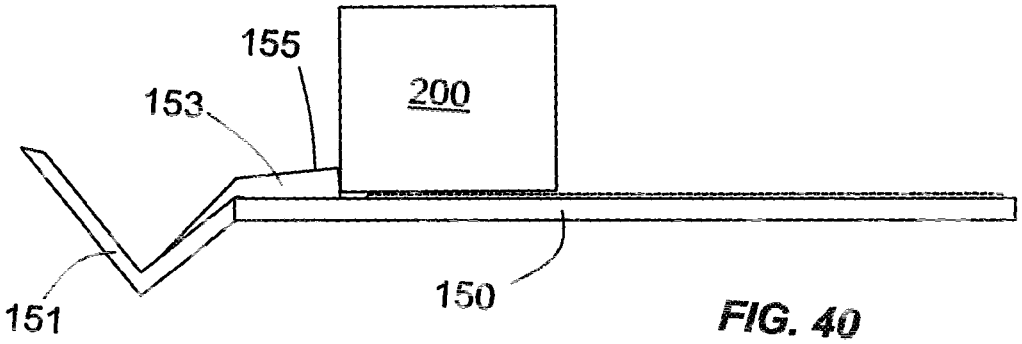

Referring to FIG. 40, the carton 200 is then pushed back by the stock person until it clears the rear wall 155 of the latch 153. The latch 153 then is biased so that it moves upward so that rear facing wall 155 faces rearward and carton 200 slides down rollers 155 so as to engage the rear wall 155 of the latch 153.

Figure 41:
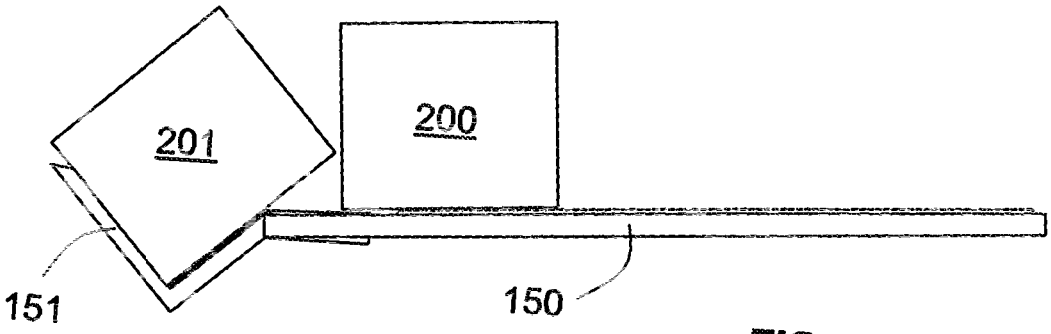

Referring to FIG. 41, the stock person then can load a second carton 201 which depresses the upper surface 155 of latch 153 allowing box 200 to slide down the rack 150.

Figure 42:
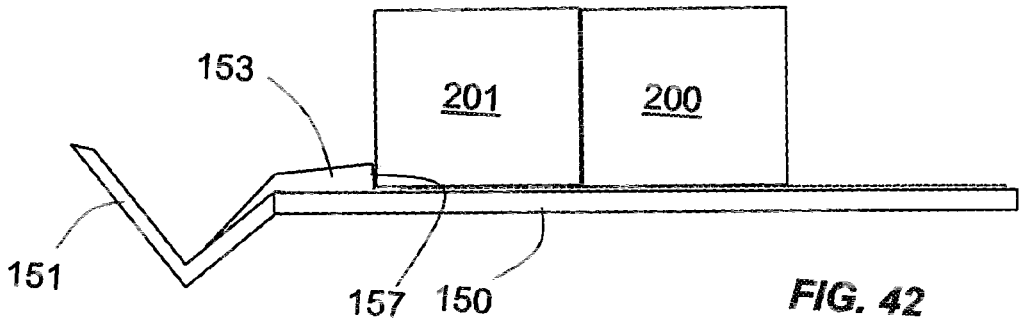
Figure 43:
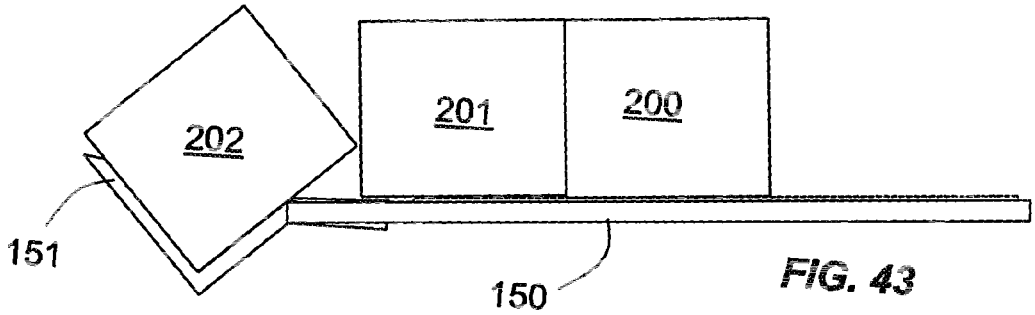

Referring to FIG. 42, the stock person then pushes carton 201 rearward with carton 200 until carton 201 is rearward of the rear wall 155 of latch 153 and the latch 153 moves upward due to its bias force, blocking the cartons 201 and 202 from sliding down the inclined surface of deck 150 toward the front end 151.

The stock person can then load still another carton 202 onto the latch which is then depressed and allows cartons 201 and 200 to slide down the inclined deck 150 to rest against carton 202.

Figure 44:
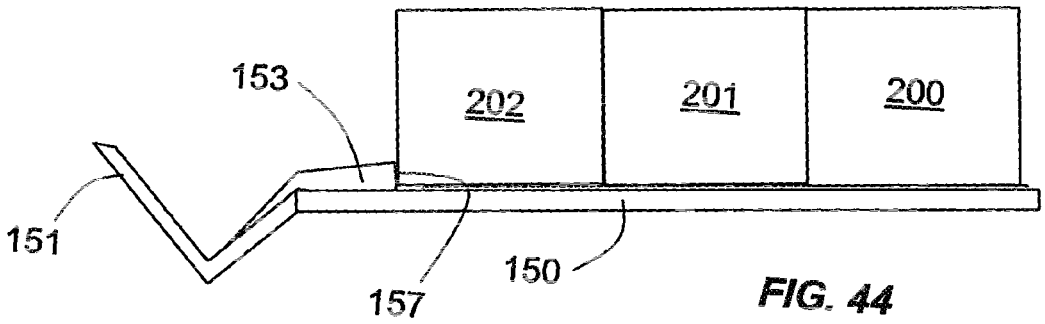
Figure 45:
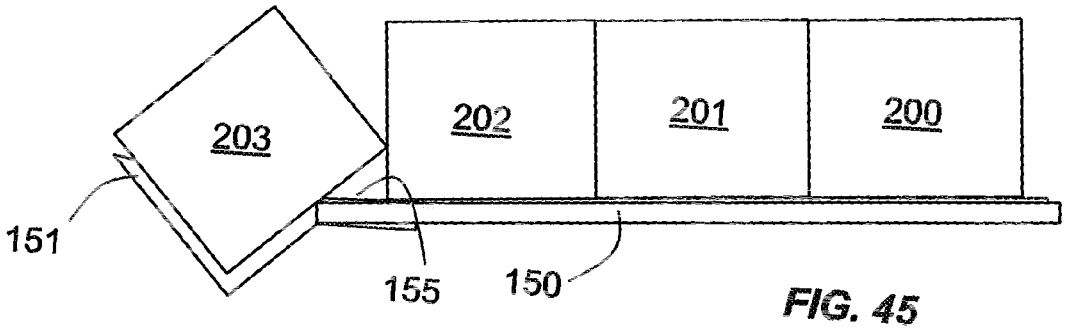

Referring to FIG. 44, the stock person then will push carton 202 rearward with cartons 201 and 200 which are also sliding on the deck 150 therewith, until the carton 202 clears the rear end of latch 153 allowing it to pop up and block movement of carton 202 forward beyond its abutment with wall 155. The stock person may place a final carton 203 in the diagonally disposed end portion 151. In this position, carton 203 rests against the top surface 155 of latch 153 and presses it below the level of the rollers 155 on rack 150. This allows the cartons 200, 201, 202 to all roll down the incline of deck 150, so that the carton 202 adjacent carton 203 rests against carton 203. At this point, the exemplary roller assembly is full, although it will be understood that a longer rack may accommodate many more cartons than just four. Also, end portion 151 may be extended so that another carton may be placed on top of carton 203 such as is shown in FIGS. 1-3.

Figure 46:
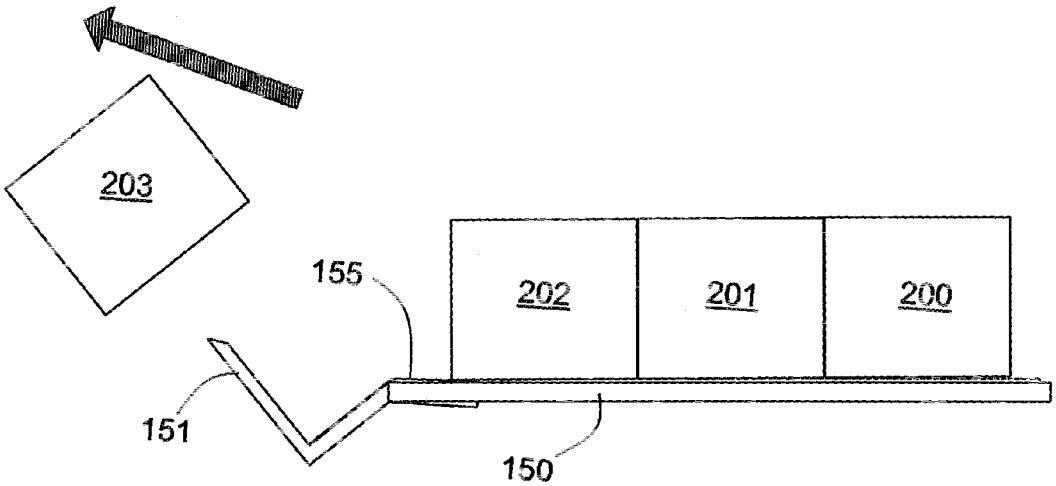
Figure 47:
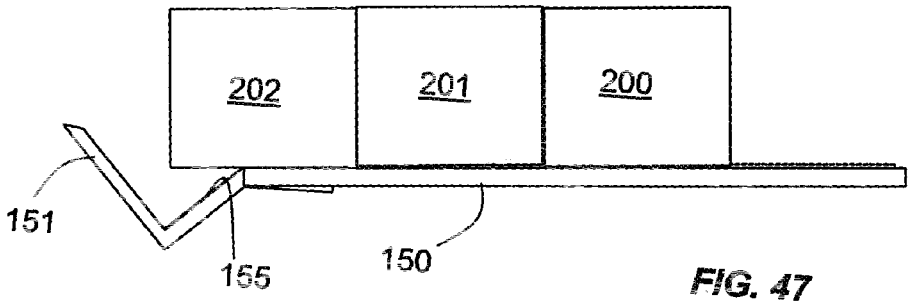
Figure 48:
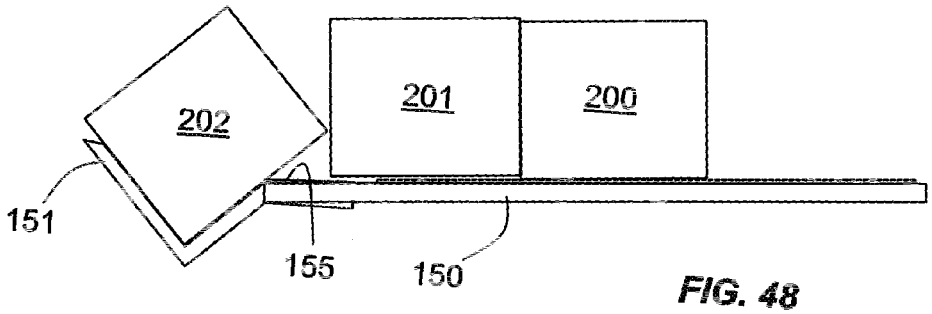

The process of withdrawing product from the display rack of the invention is shown in FIGS. 46-48. When a customer removes a product from the display rack 150, as illustrated in FIG. 46 where carton 203 is removed, the latch structure 153 remains depressed because the next carton behind the front carton, i.e. carton 202, continues to rest on upper surface 155 of latch 153 keeping it depressed below the level of the rollers on the deck 150 and allowing the boxes to move forward by virtue of gravity and the incline of the deck 150. Referring to FIG. 47, the cartons 200, 201 and 202 slide downwardly over the depressed latch 155 and maintain the latch 153 in the depressed and retracted position, while the forward most carton 202 slides to the end position, i.e. the diagonally supported position against end wall 151, seen in FIG. 48. At this point, the upper surface of 155 of the latch 153 remains depressed and the carton 201 slides there against resting against the back of carton 202. The dimensions of the latch 153 and its upper surface 155 are such that when a carton such as carton 202 is in the most forward position as seen in FIG. 48 it rests and holds the latch 153 down out of the way, and the subsequent carton such as carton 201 slides off the rollers and deck 150 to a point where it overlies the upper surface 155 of the latch as well. This means that as product is withdrawn the cartons rearward of the front position are free to slide because there is no opportunity for the latch to pop up since it will never clear the next carton. Therefore, the cartons will slide one after the other as they are removed until the rack 150 is empty. The rack then can be reloaded as described previously, and at any point in the process it may be reloaded as well with additional product from the front.

Figure 37:
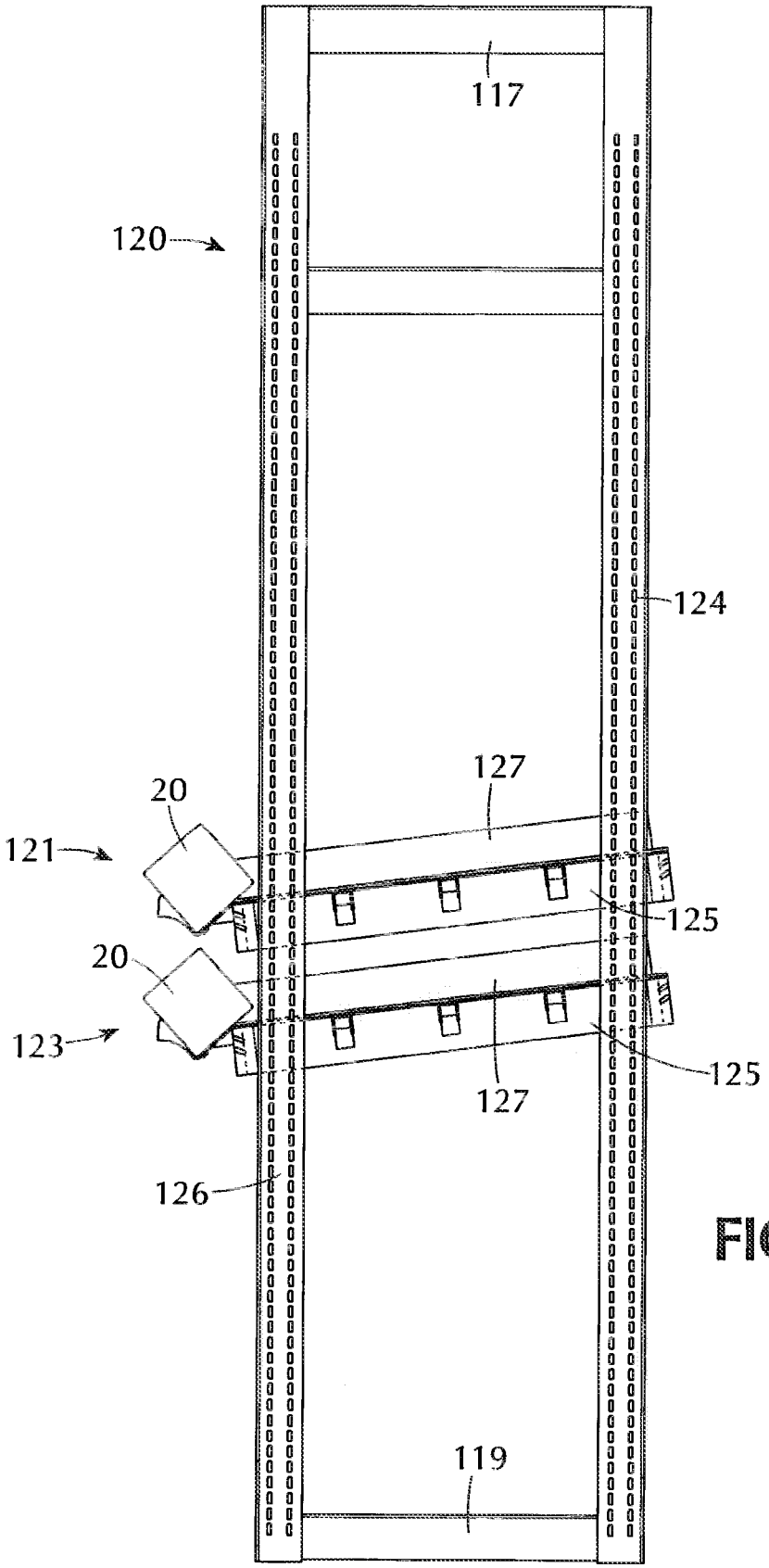
FIG. 37 is a side view of an alternate embodiment of rack for making use of slide assemblies according to the invention.

A different support structure is illustrated in an alternate environmental structure in FIG. 37. In FIG. 37, the rack which supports the carton sliding supports comprises a frame with laterally located posts with the display rack in between. The display rack 120 has a top structure 117 and a bottom structure 119 and vertically extending pillars 124 and 126 which have a vertical series of slots that allow placement of hooks as is well known in the art for attachment of structures to be supported thereon. The tilted carton sliding display racks 121 and 123 are each supported on a respective obliquely connected member 125 that hooks into these recesses and is supported laterally inward from the posts 124 and 126 at an angle of approximately five degrees (5°) to provide for the gravitational sliding of the cartons on the racks when loaded. The racks 127 are similar to the ones shown in previous embodiments and operate in substantially the same fashion. This structural design allows also for loading from the rear of the display 120 since there is no post in the way. It is nonetheless still desirable to employ the claimed system to this type of gondola or display rack environment because it allows for replacement of cartons once removed by pushing back the other cartons rearward thereof.

The terms used herein should be read as terms of description rather than of limitation. While embodiments of the invention have here been described, persons skilled in this art will appreciate changes and modifications that may be made to those embodiments without departing from the spirit of the invention, the scope of which is set out in the claims.

What is claimed is:

1. A product display apparatus comprising:

a frame, a product slide mechanism supported on the frame, said product slide mechanism including spaced front and rear end portions with the front end portion being lower than the rear end portion so as to define a forwardly descending product travel path therebetween, a first product stop mechanism supported adjacent the front end portion of the product slide mechanism such that a product on the product slide mechanism slides forwardly thereon and engages with the first product stop mechanism so as to be retained thereby against further forward movement in a forwardmost position; and a second stop mechanism disposed along the slide mechanism in predetermined offset relation generally rearward from the first stop mechanism, the second stop mechanism being movable into product blocking and non-blocking orientations in which a portion of the second stop mechanism, respectively, blocks and permits forward movement of products on the product slide mechanism, the second stop mechanism being biased to the blocking orientation, and wherein the product in the forwardmost position can be removed from the product display apparatus by a user; and responsive to force applied generally downwardly by the product in the forwardmost position, the second stop mechanism moving against the biasing so as to assume the non-blocking orientation.

2. The apparatus of claim 1 including a plurality of further products of common configuration having a side disposed on the slide mechanism, the side having a width extending longitudinally of the slide mechanism, the predetermined offset being selected such that, when the product is engaging the first stop mechanism, a forwardmost of the further products slides past the portion of the second stop mechanism and engages the product.

3. The apparatus of claim 1 wherein the slide mechanism includes at least one roller set that includes a plurality of rollers each having a rotation axis extending transversely of the travel path.

4. The apparatus of claim 2 wherein the slide mechanism includes at least one roller set that includes a plurality of rollers each having a rotation axis extending transversely of the travel path.

5. A display apparatus for a plurality of articles all having substantially the same size, said display apparatus comprising:

an inclined support structure sloping forwardly and downwardly and supporting the articles for sliding forward and rearward movement thereon;

a first stop structure configured to prevent forward movement of the articles beyond a first stop point, wherein each of the articles when moved to the first stop point can be removed from the display apparatus by a user;

a second stop structure supported for movement between first and second positions;

when the second stop structure is in the first position, said second stop structure being configured so as to prevent forward movement of the articles through a second stop point located at a distance rearward of the first stop point; and when the second stop structure is in the second position, the second stop structure permitting an article rear of the second stop point to move forward past the second stop point;

the second stop structure being biased so as to move toward the first position; and the second stop structure, when one of the articles is retained by the first stop structure at the first stop point, being in the second position thereof and allowing another of the articles to slide forward past the second stop point.

6. The display apparatus of claim 5, wherein the articles are all rectangular cartons of substantially the same dimensions.

7. The display apparatus of claim 5, wherein the inclined support structure comprises a pair of laterally spaced inclined sliding support structures each supporting a respective end of the articles.

8. The display apparatus of claim 7, and said display apparatus including structure that permits rearward and forward movement of the articles but prevents twisting movement of the articles, said structure including two laterally spaced walls laterally outward of the inclined sliding support structures.

9. The display apparatus of claim 7, wherein the support structures each include a respective sloping set of roller structures on which the articles can move forward and rearward, the roller structures each having a plurality of rollers supported in a coplanar relation for rotative movement.

10. The display apparatus of claim 9, the rollers each having a cylindrical shape with recesses therein that permit draining of liquid therethrough.

11. The display apparatus of claim 5, wherein the first stop structure includes a wall positioned so that a forwardmost one of the articles slides down and engages the wall, the wall being angulated relative to the inclined support structure such that the forwardmost one of the articles is rotated to a downward angle that is greater than an angle of incline of the support structure.

12. The display apparatus of claim 11, wherein the wall has an upper portion that extends upwardly above the forwardmost one of the articles such that another of the articles placed on top of the forwardmost one of the articles rests on the upper portion of the wall.

13. The display apparatus of claim 5, wherein the second stop structure comprises a latch member that is pivotably supported on the inclined support structure, said latch member having a rearward disposed abutment portion that engages a forward portion of one of the articles at the second stop point and prevents said article from moving forward, and when the latch member is pivoted toward said second position, said abutment portion of the latch member being below an upper surface level of the sliding support structure such that said article can slide forward above the abutment portion.

14. The display apparatus of claim 13, wherein the latch member has an upper surface engagement portion, and, when a forwardmost one of the articles is stopped at the first stop point, said forwardmost article rests upon the upper surface engagement portion and moves the latch member toward the second position such that the abutment portion is below the said upper surface level, and a next rearward one of the articles behind the forwardmost article slides forward and rests against a rear portion of the forwardmost article.

15. The display apparatus of claim 14, wherein the inclined support surface is angulated forward of the second stop point such that the forwardmost article is tilted forward at an angle downward that is greater than the angle of incline of the sliding support structure.

16. The display apparatus of claim 14, wherein when the forwardmost article is manually pushed rearward past the second stop point, the latch member moves so that the abutment portion is above the upper surface level, and, when the forwardmost article is released, said forwardmost article slides forward to rest against the abutment portion at the second stop point, leaving a space open forward thereof into which an additional article may be loaded onto the display apparatus.

17. The display apparatus of claim 5, wherein the second stop structure is biased to the first position by a spring structure or a counterweight structure.

18. The display apparatus of claim 5, wherein the display apparatus is supported on a vertical post having a series of vertical slots therein, and said display apparatus has a rearward portion having a plurality of hook structures extending into the slots and releasably securing the display apparatus thereto, one of said hook structures having an upward protruding portion extending into a slot of the vertical member configured that to remove the display apparatus from the vertical member, the display apparatus must be first lifted upward, and then tilted with a forward portion thereof elevated before the display apparatus can be withdrawn forwardly from the vertical post.

19. The display apparatus of claim 5, wherein the display apparatus includes an understructure on which the inclined support structure is fixedly secured, said understructure including a plurality of lateral members each having an upper wall comprising a pair of flanges defining a laterally extending slot therebetween in the upper wall, said support structure having a bolt supported therein screwed into an attachment member, said attachment member being narrower in a first horizontal direction than the slot, and being wider than the slot in another perpendicular horizontal direction, such that the attachment member is inserted into the slot and the bolt is then turned so as to cause the attachment member to be entrapped below the flanges of the upper wall and to secure the support structure to the lateral member.

20. The display apparatus of claim 19, wherein the attachment member is tapered in the first horizontal direction at an upper end and a lower end thereof such that the attachment member can be readily inserted into and removed from the slot during assembly or disassembly of the display apparatus.

21. A display apparatus for a plurality of articles all having substantially the same size, said display apparatus comprising:

an inclined support structure sloping forwardly and downwardly at a first angle and supporting the articles for sliding forward and rearward movement thereon;

a tilted support structure supported at a forward end of the inclined support structure and supporting a forwardmost of the articles at a forwardmost display location;

the inclined support structure and the first angle being such that said articles move by force of gravity to slide forward on the support structure and to the forwardmost display location on said tilted support structure;

said tilted support structure tilting the forwardmost of the articles forward at a second angle that is steeper than the first angle so that an upwardly disposed space is defined between the forwardmost of the articles and another of the articles located immediately rearward thereof and resting thereagainst;

wherein the tilted support structure includes a pair of tilted support portions spaced laterally of each other and defining therebetween a space across which the forwardmost of the articles extends;

wherein the tilted support structures provide clearance such that the forwardmost article can be removed from the display apparatus by a user lifting the forwardmost article above the tilted support structures and removing the forwardmost article forwardly from the display apparatus with continuous support thereunder of one or more hands of the user passing through said space; and wherein the inclined support structure comprises a pair of generally vertical laterally spaced side walls spaced laterally of each other at a distance greater than a lateral length of the articles, said distance being such that the walls prevent twisting movement of the articles when sliding forward or rearward on the inclined support structure; and wherein each of said tilted support portions has a respective first tilted wall portion extending downwardly from the front end of the inclined support structure at a slope according to the second angle.

22. The invention according to claim 21, wherein said first angle is about 5 degrees and the second angle is about 45 degrees.

23. The invention according to claim 21, wherein the inclined support structure comprises a pair of laterally spaced inclined decks having roller structures on which the articles are supported.

24. The invention according to claim 21, wherein each of the tilted support portions has a respective second tilted wall portion connected with a forward end of the respective first tilted wall portion and perpendicular thereto.

25. The invention according to claim 24, wherein the first tilted wall portion extends less than a bottom side dimension of the articles so that a portion of a bottom side of the forwardmost of the articles extends above the end of the inclined support structure.

26. The invention according to claim 24, wherein the second tilted wall portion extends above the fowardmost of the articles so that another of said articles may be placed on top of the forwardmost of the articles so as to rest thereon and on the second tilted wall portion.

27. The invention according to claim 24, wherein the display apparatus further comprises a latching structure that prevents forward movement of the articles past a stop point when none of the articles are supported on the tilted support structure, and permits forward movement of the articles past the stop point when the tilted support structure supports the forwardmost of the articles.

* * * * *